US007740509B2

(12) United States Patent
Aparici Ballester et al.

(10) Patent No.: US 7,740,509 B2
(45) Date of Patent: Jun. 22, 2010

(54) ELECTRICAL WIRE CONNECTOR

(75) Inventors: Carlos Aparici Ballester, Valencia (ES); Ramon Asensio Camacho, Valencia (ES)

(73) Assignee: Tyco Electronics Raychem SA, Alcobendas (Madrid) (ES)

( * ) Notice: Subject to any disclaimer, the term of this patent is extended or adjusted under 35 U.S.C. 154(b) by 280 days.

(21) Appl. No.: 11/920,107

(22) PCT Filed: Apr. 19, 2006

(86) PCT No.: PCT/GB2006/001422

§ 371 (c)(1),
(2), (4) Date: Nov. 8, 2007

(87) PCT Pub. No.: WO2006/120373

PCT Pub. Date: Nov. 16, 2006

(65) Prior Publication Data

US 2009/0098756 A1 Apr. 16, 2009

(30) Foreign Application Priority Data

May 10, 2005 (GB) ..... 0509464.4
Sep. 23, 2005 (GB) ..... 0519447.7
Jan. 10, 2006 (GB) ..... 0600370.1

(51) Int. Cl.
*H01R 4/28* (2006.01)

(52) U.S. Cl. ..... 439/725; 439/341

(58) Field of Classification Search ..... 439/341, 439/395, 404, 532, 715–717, 725, 727
See application file for complete search history.

(56) References Cited

U.S. PATENT DOCUMENTS 3,848,954 A * 11/1974 Sedlacek ..... 439/392
4,286,836 A 9/1981 Rumps
4,701,138 A 10/1987 Key
4,822,300 A * 4/1989 Gerke et al. ..... 439/417
5,187,861 A * 2/1993 Hillegonds et al. ..... 29/751

(Continued)

FOREIGN PATENT DOCUMENTS

EP 0 228 723 A2 7/1987

(Continued)

OTHER PUBLICATIONS

Patent Search Report for GB0509464.4 issued by the Patent Office dated Jun. 29, 2005.

(Continued)

*Primary Examiner*—Khiem Nguyen
(74) *Attorney, Agent, or Firm*—Baker & Daniels LLP

(57) ABSTRACT

Electrical connectors, particularly for connecting telephone wire pairs, are disclosed in which connector strips having at least one row of apertures containing wire connection terminals is provided with at least one captive wire insertion tool which can push or otherwise force wires into terminals of the connector strip to establish electrical connection. The or each tool is mounted for captive sliding movement relative to the strip to position the tool with a selected one of the apertures in which a wire connection is to be made. In one form of the invention, a tool is adapted to slide along the strip so that it can be positioned at each aperture. In a further embodiment, the strip is provided with a plurality of tools, one for each aperture.

29 Claims, 36 Drawing Sheets

U.S. PATENT DOCUMENTS

| | | | | |
|---|---|---|---|---|
| 5,295,857 | A | 3/1994 | Toly | |
| 5,634,811 | A | 6/1997 | Heng et al. | |
| 5,820,420 | A * | 10/1998 | Bechaz et al. | 439/716 |
| 2002/0061675 | A1 | 5/2002 | Borst | |

FOREIGN PATENT DOCUMENTS

| | | | |
|---|---|---|---|
| FR | 2 746 219 | A | 9/1997 |
| GB | 1 591 586 | A | 6/1981 |
| WO | WO 01/06597 | A | 1/2001 |
| WO | WO 03/043136 | A | 5/2003 |
| WO | WO 03/043140 | A | 5/2003 |

OTHER PUBLICATIONS

International Search Report for PCT/GB2006/001422 issued by the European Patent Office dated Oct. 27, 2006.

* cited by examiner

ELECTRICAL WIRE CONNECTOR

This invention relates to an electrical wire connector, of the type also known as a "magazine", having at least one row of apertures containing connector terminals into which wires are inserted in use and pushed into the terminals to establish electrical connections, for example between several pairs of telecommunications wires coming from the exchange and corresponding wire pairs leading to other equipment and/or to individual service subscribers. Although insulated wires having pre-stripped ends could be used, it is usual for the wires to be unstripped and for the terminals to be insulation-displacing connection (IDC) terminals, which cut or penetrate the insulation to establish the electrical connection when the wires are pushed laterally into the terminals.

Various forms of connector strips or "magazines" of this general kind are known, as described for example in published International Applications WO-A-01/06597, FIG. 10 of which is reproduced as FIG. 1 of the accompanying drawings, and WO-A-03/043140, FIG. 1 of which is reproduced as FIG. 2 of the accompanying drawings. In use, the wires 1 are laid across apertures 2 behind which are cylindrical terminals 3 having slots formed therein into which the wire ends are located and pushed down laterally as indicated by the arrow A (with respect to the longitudinal direction of the wire) into the terminals by means of a hand-held insertion tool. Various forms of the tools are known and usually have a pusher head at the end of a shaft and handle, the pusher head being formed to fit into the terminal-containing apertures of the strip in order to enable the installer holding the handle to push the wires one-by-one into the terminals. Problems arise when the installer either mislays or forgets the installation tool, or has only a tool which does not fit the form of connector strips present at the installation site in question. Attempts to alleviate these problems by providing each connector strip with its own installation tool of relatively small size and cost, for example a disposable plastics tool removably attached to the end of the connector strip, as described in WO-A-01/06597, have not been entirely successful, since these small tools are easily lost or taken away instead of being replaced after use as intended.

The present invention addresses these problems by providing an electrical connector comprising a connector strip having at least one row of apertures containing wire connection terminals, and at least one captive wire insertion tool capable in use of pushing or otherwise forcing wires into the terminals to establish electrical connection, wherein the tool is arranged for captive sliding movement relative to the strip to position the tool with a selected one of the apertures in which a wire connection is to be made.

The present invention also provides a connector strip having at least one row of apertures containing wire connection terminals, and having at least one captive wire insertion tool capable in use of pushing or otherwise forcing wires into the terminals to establish electrical connection, wherein the tool is arranged for captive sliding movement along the row to align the tool selectively with any one of the apertures in which a wire connection is to be made.

In a first form of the present invention, the insertion tool is arranged to slide along the row of apertures of the connector strip so as to align the tool selectively with any one of the apertures in which the wire connection is to be made.

In a second form of the present invention, the electrical connector is provided with a plurality of insertion tools, one for each aperture, and each individual insertion tool is arranged to both insert and connect a respective wire pair to the connector strip, the insertion tool being slidably movable between a first disengaged position and a second position in which it secures a wire pair to the connector strip.

It will be appreciated that electrical connectors having one or more captive sliding wire insertion tools according to the invention provide the advantage that the correct tool is not only present on each connector strip, but cannot normally be lost or removed. This facilitates installation, and reduces time which might otherwise be lost by the installer in obtaining the correct tool and/or holding or locating the tool during alignment and insertion of wires in the connector strip. In operation, pressure may be applied to an appropriate part of the pusher, preferably an exposed end of the pusher, to move it into the aligned aperture and thus to force the wire into the terminals to establish the electrical connection. The actuating pressure for all aspects of this invention may be applied by hand, although this becomes tiring on frequent repetition to install a large number of connections, or by any convenient implement which the installer may have, such as a screwdriver, thus avoiding the undesirable need for special tools.

In the aforementioned first form of the invention, the installation tool provided by a connector according to this invention is preferably held captive in a slide housing which is permanently or removably mounted on top of the row of apertures in the connector strip. A separate slide housing may be provided for fitting, preferably snap-fitting, on top of an existing connector strip, and such a discrete slide housing, with or without the wire insertion tool pre-fitted therein, itself constitutes another aspect of this invention. Alternatively, the slide housing may be formed integrally with the connector strip, for example by moulding from suitable plastics material, which may be the same as that preferably used to mould the housing of the connector strip, as known per se.

The wire insertion tool preferably comprises a slidable carrier portion, which is captively held in the slide housing, for example by engagement, for example snap-fitting, of projections or grooves on the carrier into engagement with grooves or projections arranged along the sides of the slide housing extending along the connector strip adjacent to the row(s) of terminal containing apertures. A wire pusher or other inserter member (hereinafter "pusher" for brevity) is carried by the carrier portion in such arrangement that the pusher can be repeatedly moved, preferably against a suitable return spring, to force the wires into the respective terminals. It is to be understood that the "pusher" could in principle be arranged to pull or drag the wires into the terminals, but a direct pushing action is preferred in practice.

In some forms of connectors according to the invention, two or more wire insertion tools may be provided, and this may be especially useful for connector strips having two or more rows of the terminal-containing apertures, in which one or more tools may be provided on each row. Alternatively, a single tool may be provided with a carrier which has two pushers, one for each row. As a further alternative, a single tool can be provided which can be rotated or otherwise moved on or in the slide housing to align its pusher with a selected one of the rows. Alternatively, the tool may be provided with a pusher which is rotatable or otherwise movable in or on the slidable carrier to align the pusher with a selected one of the rows. In this case, the carrier may bridge both or all of the rows of apertures, enabling selective alignment of the pusher with one row or another. The tools will preferably carry some form of indicator to show the installer which of the rows of apertures the tool is aligned to act upon.

Detent means are preferably provided for positive location of the tool in alignment with each selected aperture. The detent may for example comprise a resilient member on the slidable carrier which engages with suitable depressions or other formations on the slide housing, or on the connector strip itself, to indicate that the sliding tool has achieved correct alignment. Preferably, the detent will be arranged to emit an audible "click" or other sound when the aligning engagement occurs.

The slide housing may include a non-aligned extension region at one or both of its ends, onto which region the tool may be slid out of the way while wires are being laid across the apertures in the connector strip ready for insertion into the terminals.

Each of the terminals will preferably be associated with a cut-off blade or other member as known per se for cutting off the free end of the wire extending beyond the terminals. This may preferably be done during, or immediately at completion of, the wire-pushing operation which effects the electrical connection, using suitably shaped insertion tool heads, also known per se.

An alternative aspect of the present invention provides an electrical connector comprising a connector strip having at least one row of apertures containing wire connection terminals wherein some or preferably all of the apertures have individually dedicated manually-engageable wire insertion and cutting tools pre-inserted therein or immovably aligned therewith, each such tool being dedicated to establish electrical connection by pushing or otherwise forcing a wire into the terminals exclusively of its own aligned aperture or apertures, characterised in that each such tool has at least a wire-engaging portion of a cross-sectional area substantially equal to that of its aligned aperture and an associated cut-off blade or other member for cutting off the free end of the wire extending beyond the terminals.

It will be understood that matching the cross-sectional ("footprint") area of the tools approximately to that of the apertures, according to the first alternative of this aspect of the invention, enables space-saving compaction of the connector strip. Electrical connectors comprising connector strips having the individual tools in association with cut-off blades, according to the second alternative of this aspect of the invention, are believed to be previously unknown.

The individually dedicated wire insertion tools may be at least partially inserted in the apertures or attached to the strip in a manner such that they are aligned with the apertures for subsequent insertion therein.

Each wire insertion tool can be is formed as a one piece element having guides arranged to be received in the connector strip whereby the wire insertion tool can move linearly between a position awaiting insertion of wires into the connector strip and a position in which the tool retains the wires therein.

The tools may be captively or removably secured in, or aligned with, the apertures by any suitable structure, for example by frictional fit of the tools in the apertures, or by snap-fitting or other attachments gripping or otherwise holding the tools in contact with the structure of the connector strip. Very simply, the wire insertion tool can readily be formed with a part arranged to engage detents provided on or by the connector strip to retain the tool in each of the two positions.

Specific embodiments of the invention will now be described by way of illustrative example with reference to the accompanying drawings in which:—

FIG. 45 is a perspective view of the strip shown in FIG. 28 but including a modification thereto and FIGS. 45A and 45B are plan and side views of a track segment for use therewith;

Figure 1:
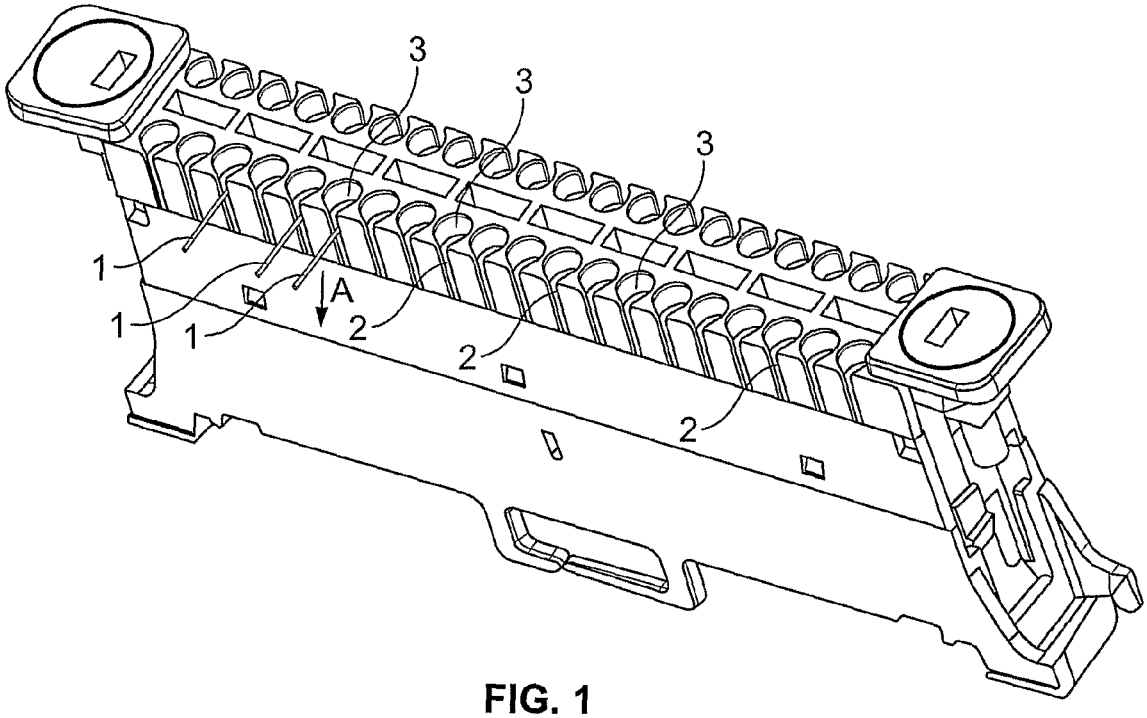
FIG. 1 shows a connector strip as disclosed in FIG. 10 of published international patent application No. WO-A-01/06597.
Figure 2:
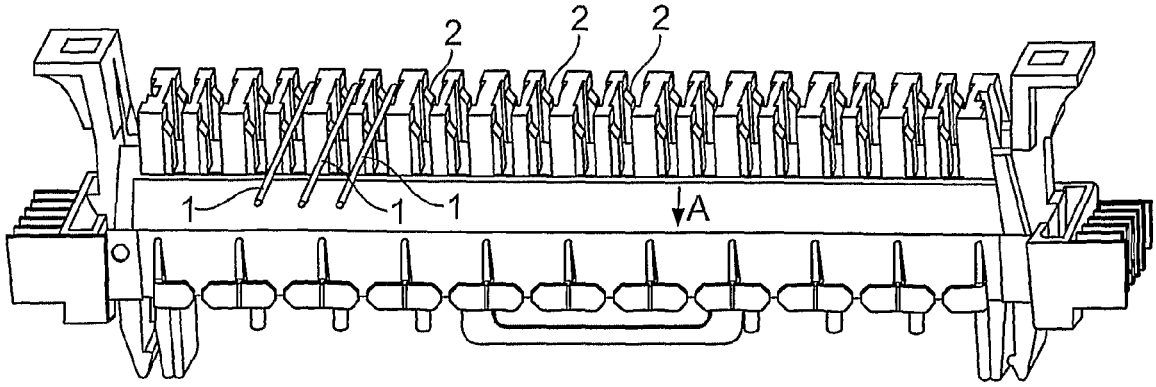
FIG. 2 shows a connector strip as disclosed in FIG. 1 of published international patent application No. WO-A-03/043140.
Figure 3:
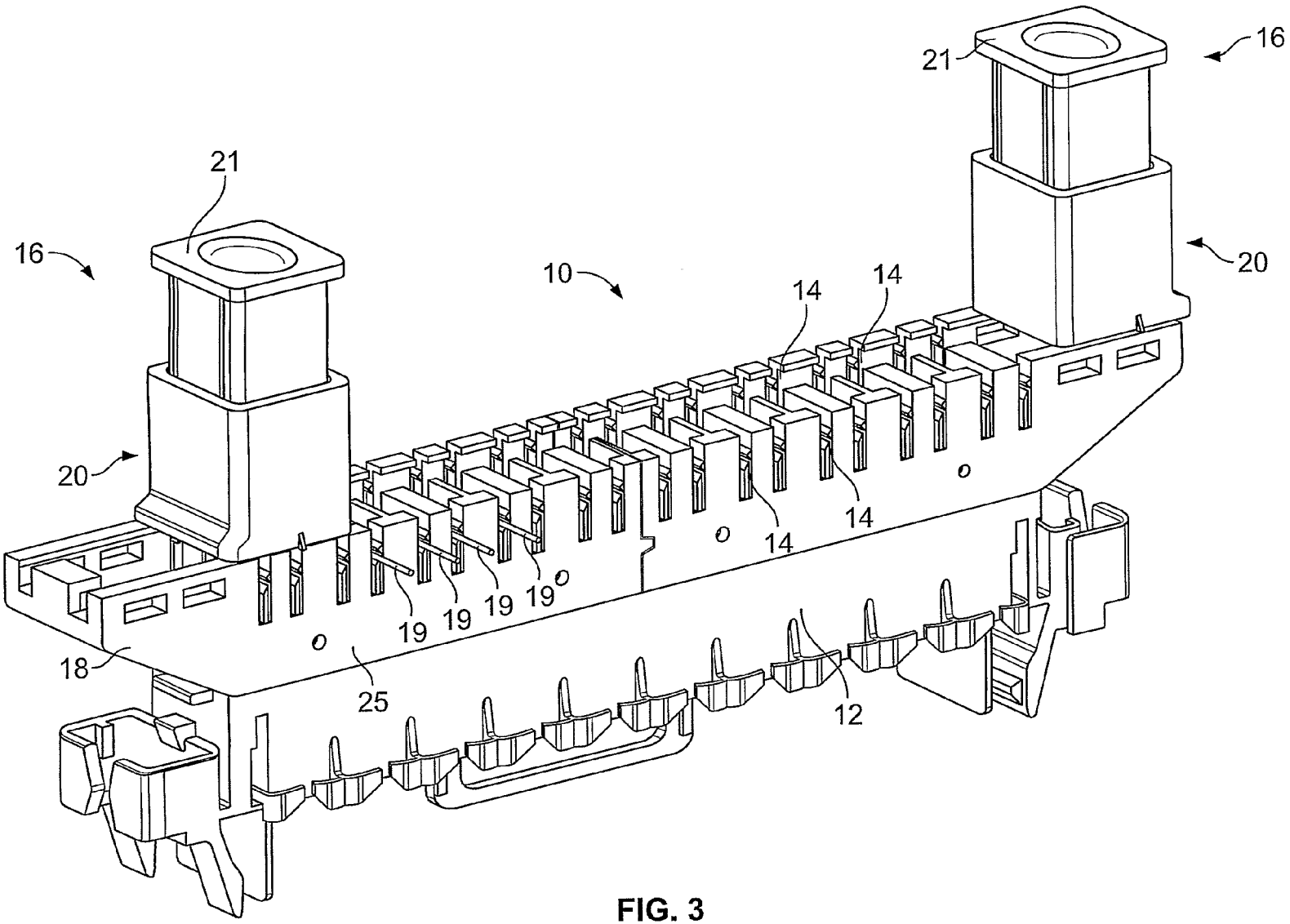
FIG. 3 is a perspective view of an electrical connector according to a first embodiment of the present invention which has a connector strip with two rows of apertures containing insulation-displacing connector terminals and two insertion tools.

FIG. 3 shows an electrical connector 10 according to the invention comprising a connector strip 12 having two rows of insulation-displacing connector terminals such as are illustrated in FIG. 2, and two wire insertion tools 16 for securing end portions of those wires through apertures 14 in side walls of the connector strip to those terminals. The design and configuration of the apertures per se and of the connector terminals is known in the art and will not be further described except to the extent necessary for an understanding of the present invention. Each insertion tool 16 is used for one side of the strip, so one is provided for the "central" side and the other for the "jumper" side. The strip 12 also comprises a static or removable slide housing 18 for each of the insertion tools 16, each insertion tool being designed for inserting and cutting the wires 19, and slidable carriers 20 for moving pusher members 21 of the insertion tools along the slide housing(s) 18. In this and the following illustrated embodiments of the invention, the slide housings are shown as mounted on a chassis 23 of the connector; however it is to be clearly understood that these slide housings may be provided as removable parts of a connector, securing of the parts being by any suitable engagement means such as snap fitting or friction fit of the housings onto the connector strip chassis 23. Where the slide housing is provided as a snap on or otherwise securable element of the connector, as opposed to being integrally formed with the chassis of the connector strip, the slide housing is formed by injection moulding of a suitable plastics material and is formed to include the aforementioned apertures 14 through which wires can be inserted for connection to the terminals mounted in the chassis. The apertures 14 are formed in walls 25 of the slide housing 18, which walls extend downwardly to partially embrace sides of the connector strip chassis. Though not shown, the walls 25 are designed to engage with the sides of the chassis so that the slide housing is immovable relative to the chassis once so mounted. The chassis itself comprises a backbone structure which houses the terminal connections for wires to be attached thereto and the slide housing then includes apertures through which access can be gained by the insertion tool(s) to wires in the terminals.

Figure 9:
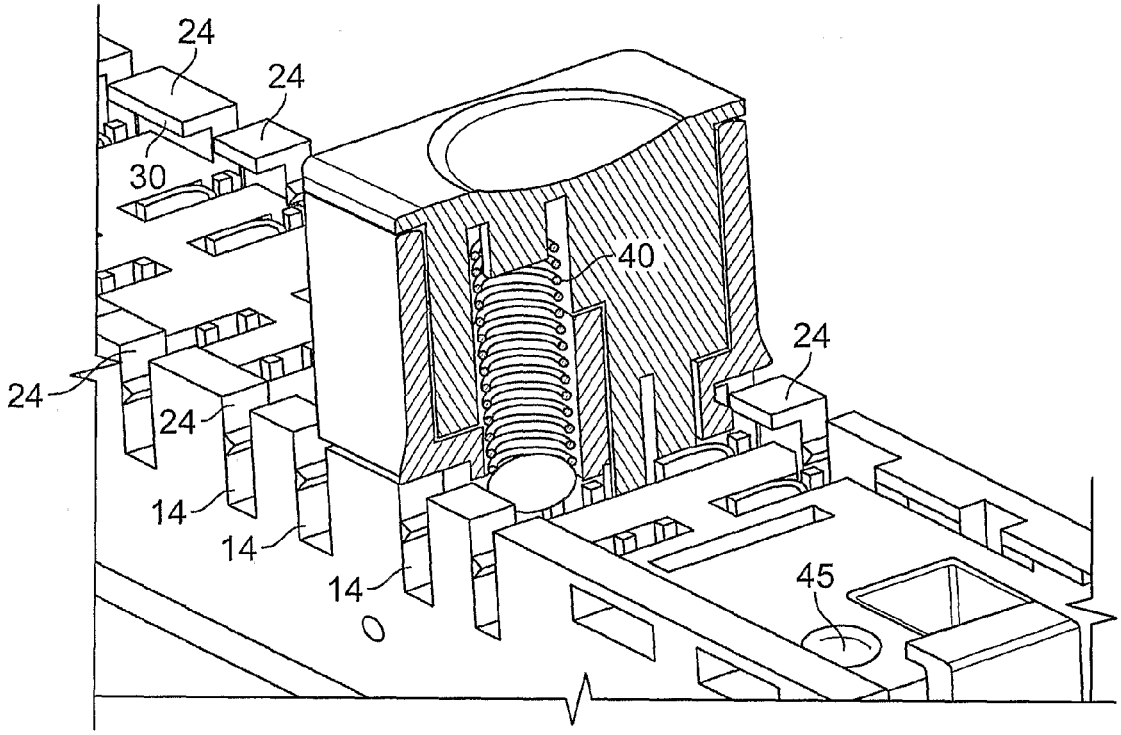
FIG. 9 is an enlarged cutaway view viewed from one end of the connector strip showing detail of an upper portion of the connector strip and the manner in which the tool fits therein.

Each slidable carrier 20 can move along the slide housing 18 thereby moving the respective pusher member 21 of the insertion tool. To this end, each slide carrier is formed with a pair of shoes 22 which slide in tracks provided by guides 24 (see FIG. 7) formed by the slide housing 18 of the connector strip 12. These guides provide aligned recesses 26 formed in uppermost portions 28 of opposed inwardly facing longitudinal faces 30 of the connector strip 12 itself. These uppermost portions 28 (FIG. 9) are formed between the apertures 14 in the connector strip and permit insertion of wire end portions as described above. Thus, the recesses are discontinuous along the length of the connector strip but are sufficiently close and are aligned to permit the shoes 22 of the slidable carriers to slide along the guides provided thereby. Each slidable carrier can be attached to the connector strip 12, or magazine, by providing bevels on lowermost outer edges of the shoes 22 so that they can be attached to the connector strip by pressing the carrier into the strip by a snap action. This configuration ensures that the movable carrier parts are entrained with the connector strip.

Figure 4:
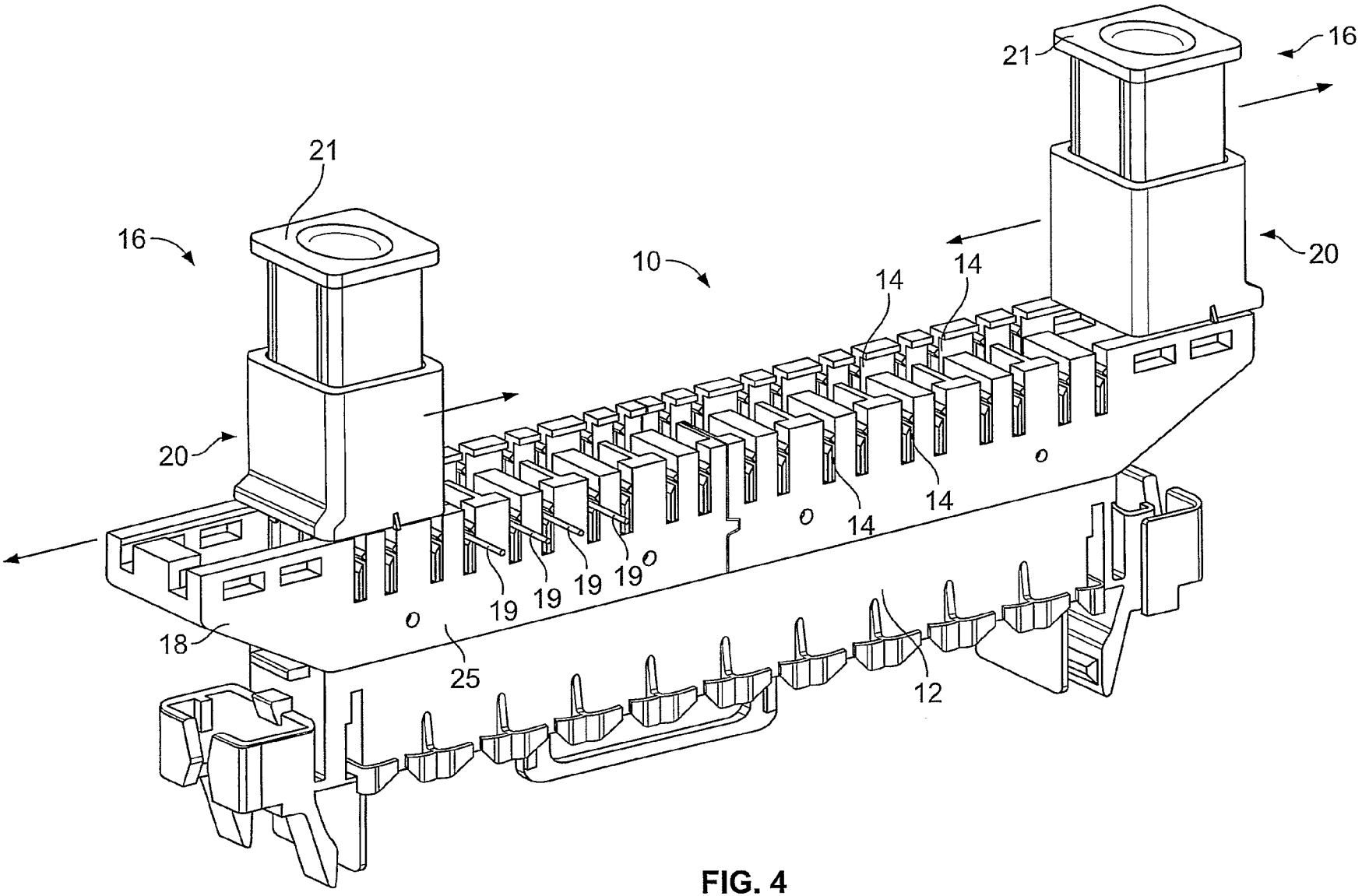
FIG. 4 is a view similar to FIG. 3 showing the manner in which insertion tools can be moved along the connector strip.

Each slidable carrier 20 can then move along the tracks, while its associated pusher member 21 can move up and down in the slidable carrier as hereinafter described. The slidable carrier and the pusher tool are the mobile parts of the product, as indicated in FIG. 4.

Figure 5:
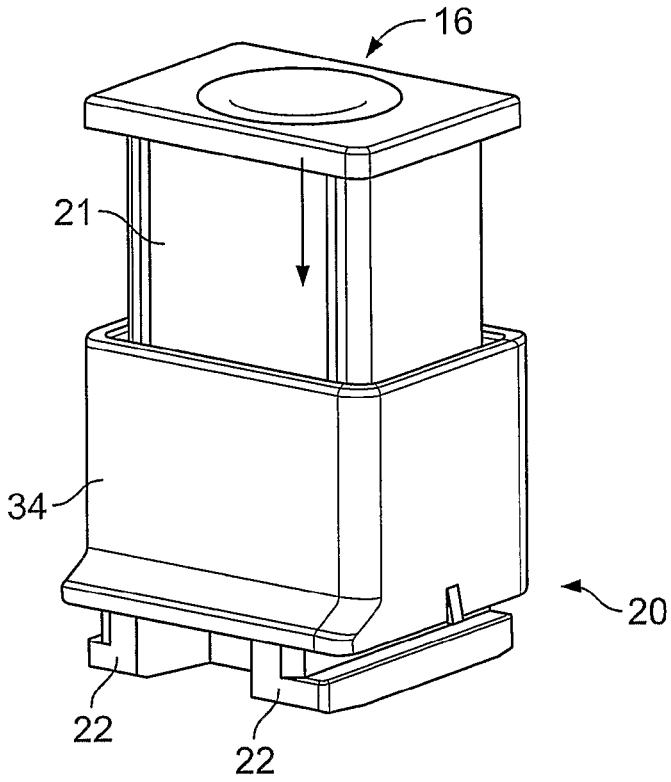
FIG. 5 is a perspective view of one of the tools shown in FIG. 4.
Figure 6:
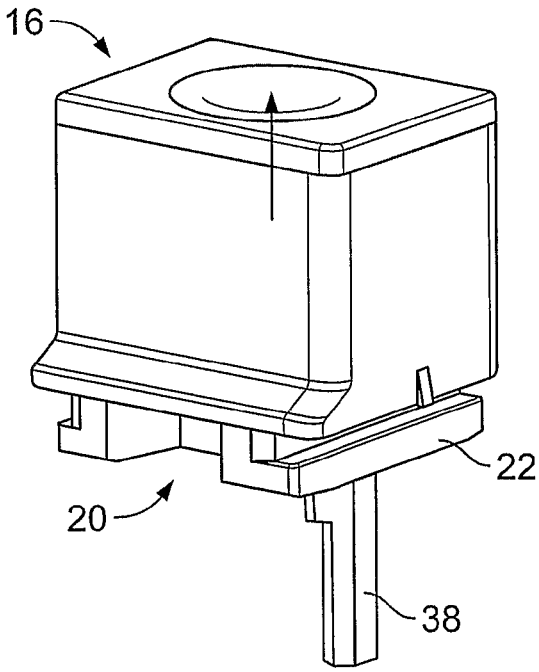
FIG. 6 is a perspective view showing the tool of FIG. 5 in depressed condition.
Figure 8:
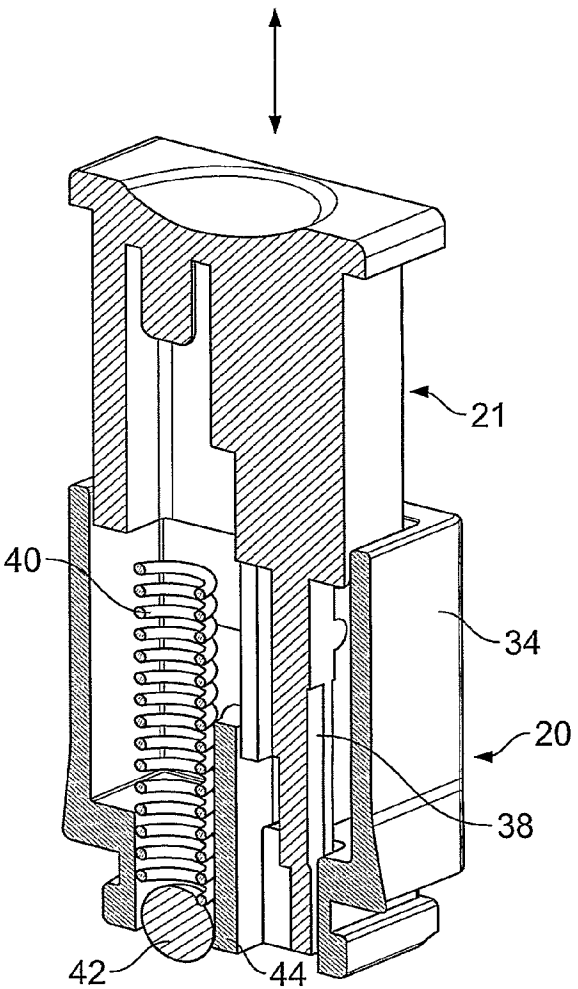
FIG. 8 is a sectional perspective view showing the insertion tool/slidable carrier combination in extended relationship.

The slidable carrier 20 is in the form of a uniformly rectangularly-sectioned hollow housing 34 (FIGS. 5 and 8) which provides a sleeve for guiding the pusher member 21 which is spring-loaded and depressible and carries a cutting blade 38 as shown in FIGS. 6 and 8. The exterior of the pusher member 21 is provided by walls extending laterally and lengthwise relative to the length of the connector strip 10 and of dimensions such that the pusher member can slide within the hollow housing 34. The function of the cutting blade 38 is to trim the end portions of wires (see FIGS. 3 and 4) that are inserted into the apertures 14, when the blade is pressed serially down into the apertures by pressing on the pusher member 21. As can be seen in FIGS. 7, 8, 9 and 10, the pusher member 21 is spring-loaded by a compression spring 40 which is mounted within the carrier 20 and is compressed between an abutment within the pusher member 21 and a spherical stop member or ball 42 mounted in a socket 44 in the base of the carrier 20 such that the pusher member normally assumes an uppermost position, as shown in FIGS. 5 and 8. The uppermost limit of travel of the pusher member 21 is limited by a detent (not shown) engaging an internal overhang of the sleeve provided by the carrier 20.

When the pusher member 21 is depressed, the cutting blade 38 is moved downwardly through an aperture in the carrier 20, and is automatically retracted into the body of the carrier when the pusher is released. To connect the wires, the pusher member and cutting blade are pushed down. The pusher member 21 has two functions: one is to push the wire into the insulation-displacing connection (IDC) to make the connection and the other one is to cut and strip the remaining wire with the cutting blade. After connecting and cutting, the pusher member 21 returns automatically to its uppermost position.

Figure 10:
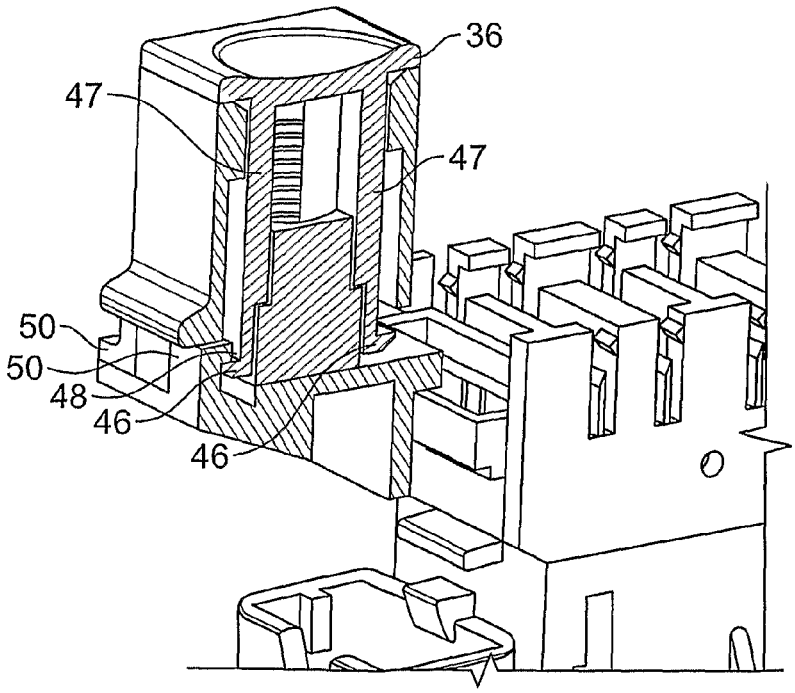
FIG. 10 is a further enlarged cutaway view of an upper portion of the connector strip showing the manner in which the tool is retained at one end of the connector strip.

As the slidable carrier 20 moves along the connector strip 12, it can be held in position at each of the apertures 14 as the ball 42 engages physically in the uppermost extremity of the cylindrical terminal in each aperture 14. The ball 42, under the influence of the spring 40, is urged into each upper terminal end provided in the aperture to engage therein and prevent further inadvertent movement until the pusher 21/carrier 20 combination is physically urged by finger pressure to cause the ball to disengage from the aperture, as indicated in FIG. 10. At the time of engagement in an aperture, the ball makes an audible sound such as a click to mark the position.

At each end of the strip, and formed in an upper surface thereof is an indent 45 arranged to receive the ball 42 at each end of movement of the tool 16/carrier 20 combination to retain the combination in position until required.

As shown in FIG. 10, at each end of the slide housing 18 there is provided means for securing the pusher member 36 in a depressed position so that the height of the insertion tool 16 is reduced while it is not being used, thus reducing the possibility of damage to the connector. This means comprises a foot 46 extending from a lower edge of each of the lateral walls 47 of the pusher member 36. Provision of a foot on each wall means that the same effect can be achieved at each end of the connector strip. As shown in FIG. 10, the foot 46 can engage a projection 48 formed on each of two upstanding leg portions 50 at each end of the connector strip 12 so that the pusher member is held in a depressed position at the end of travel along the strip 12. When the insertion tool 16 is released, the pusher member automatically then moves back up to the operating position as shown in FIG. 8, on manual application of a small releasing force to move the slide member in the direction of travel along the strip.

Figure 11:
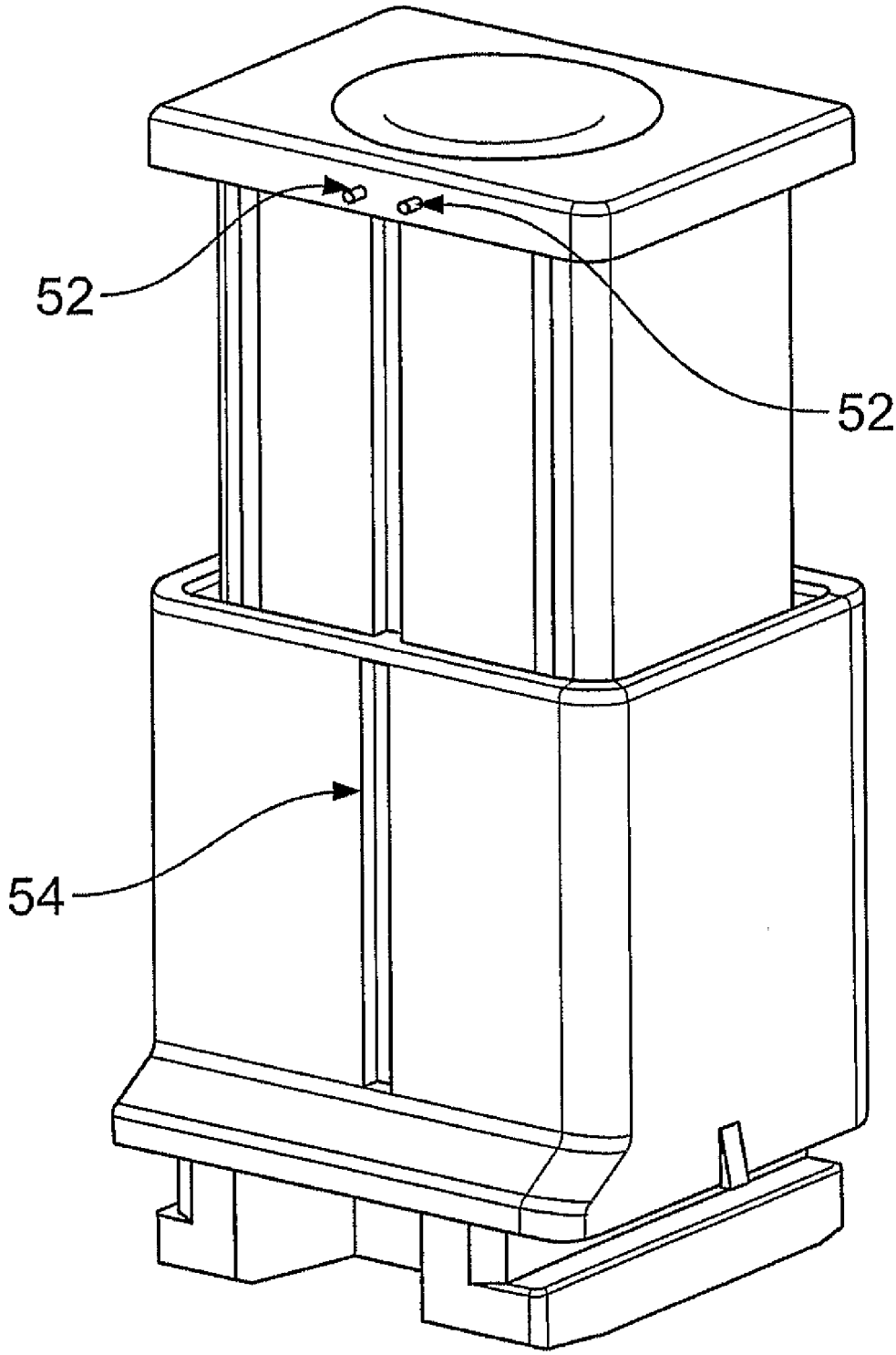
FIG. 11 is a perspective view of a modified tool showing alignment indicators for aligning the tool when in use.
Figure 12:
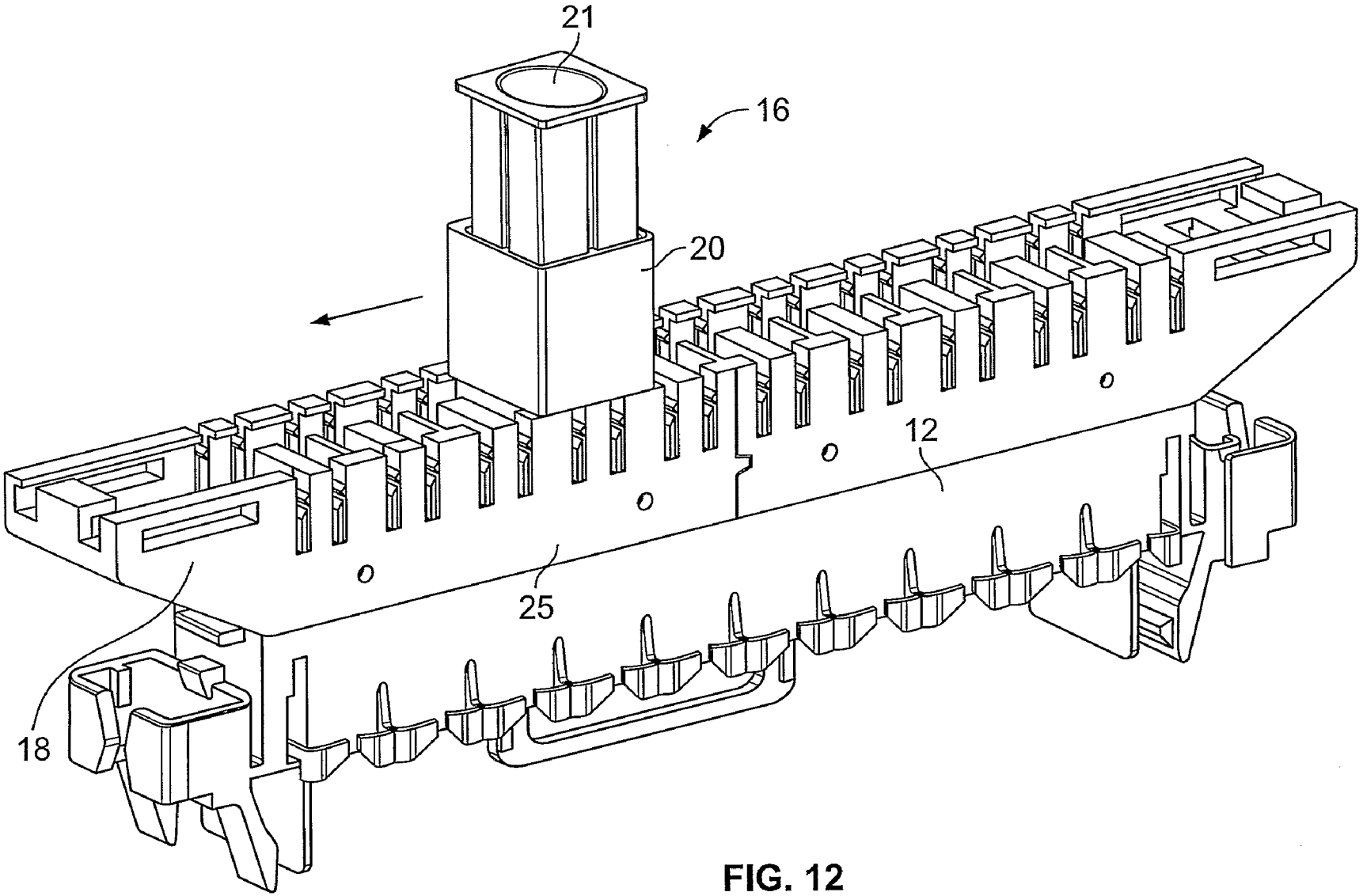
FIG. 12 is a perspective view of an electrical connector according to another embodiment of the present invention having a rotatable tool mounted on a connector strip in accordance with a further embodiment of the present invention and showing the manner in which the tool can be moved in a first direction along the strip.
Figure 13:
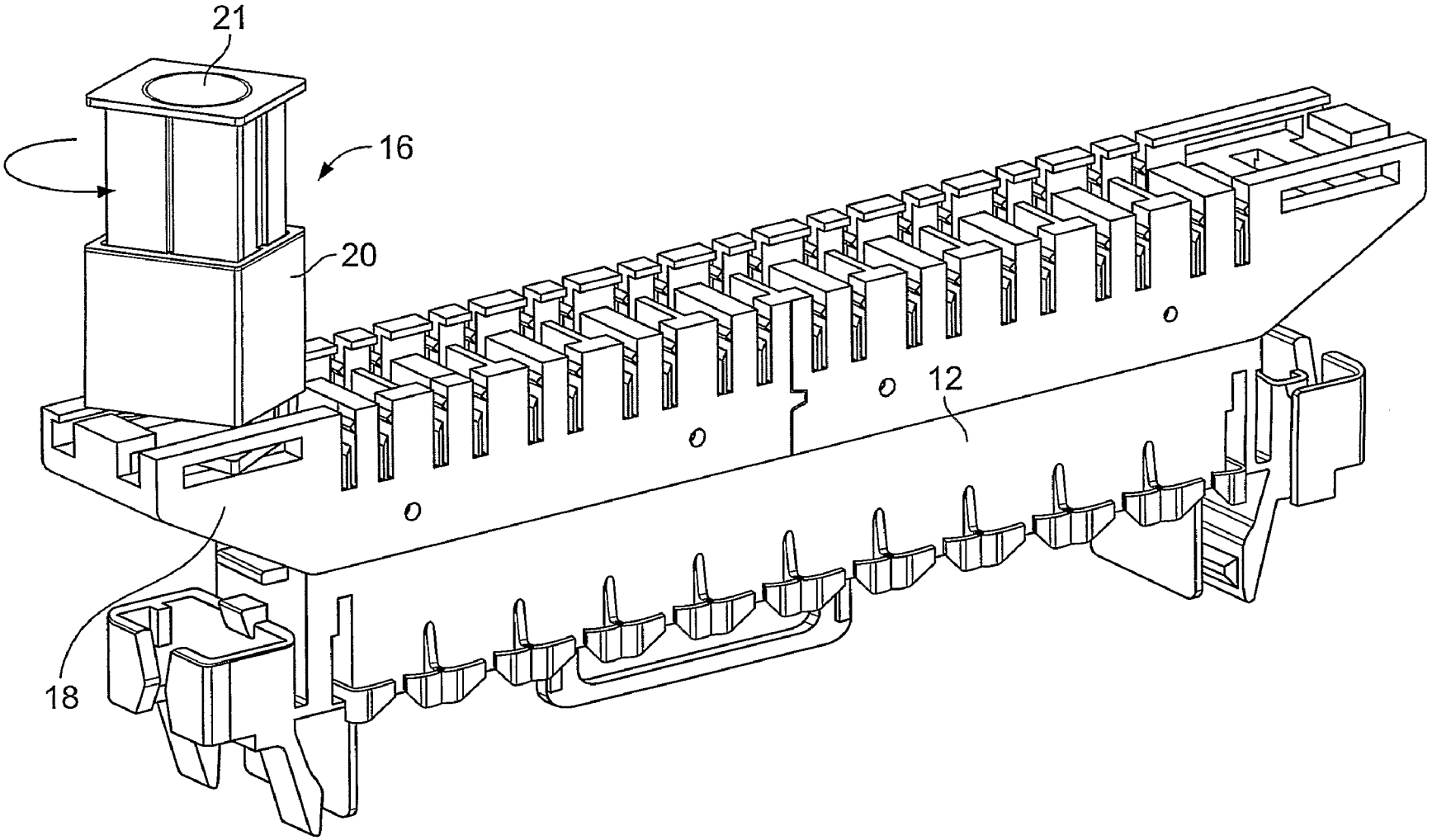
FIG. 13 is a perspective view, similar to that of FIG. 12, showing the manner in which the tool can be rotated on the connector strip.
Figure 14:
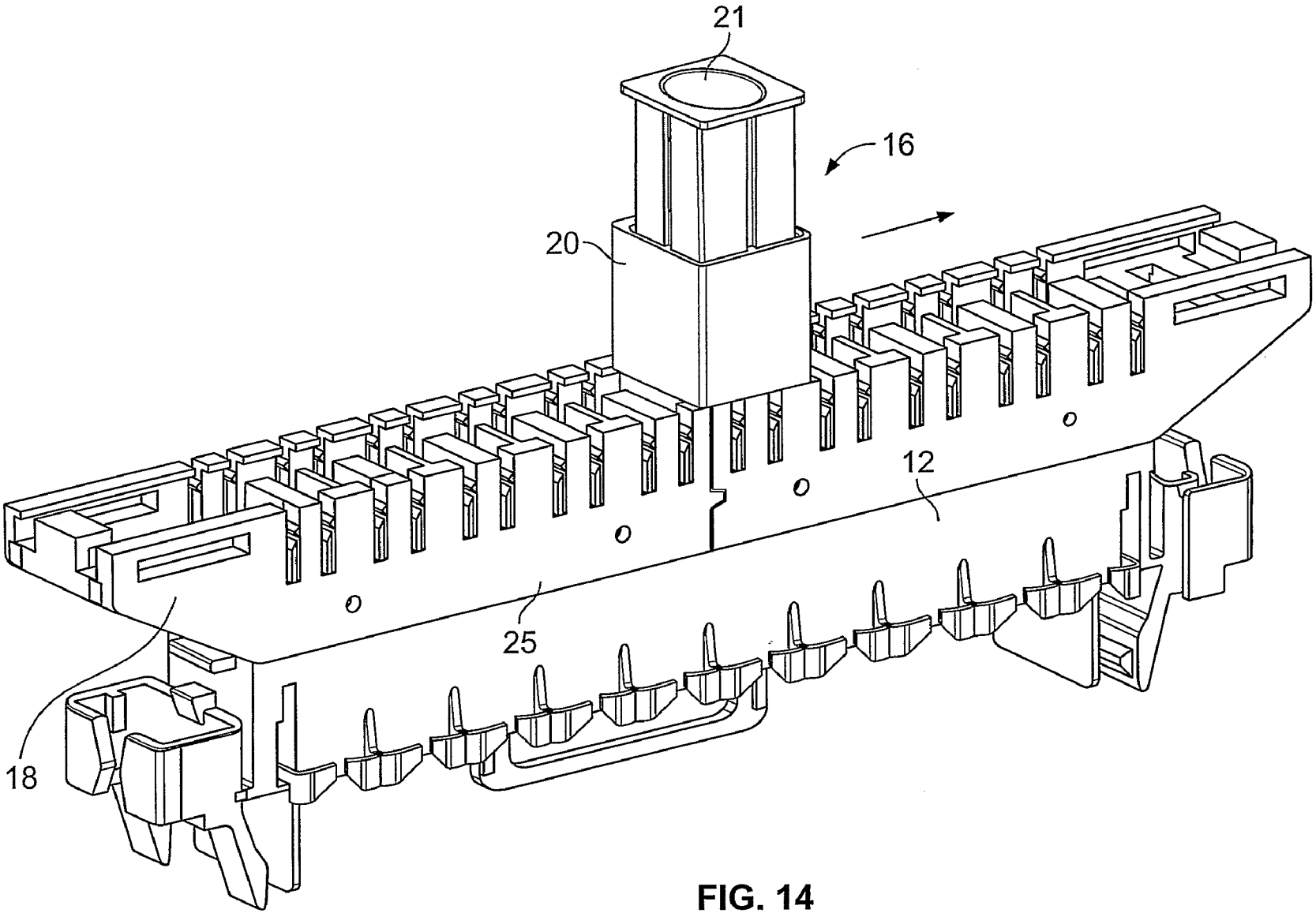
FIG. 14 is a perspective view, similar to that of FIGS. 12 and 13, and showing the manner in which the tool can be moved in a second direction along the strip.

In the head of the pusher member 21, as shown in FIG. 11, there can be provided projections 52 of plastics material to help the installer to align the wire to be connected. Alternatively or in addition, there may be one or more marked lines 54 on the pusher member and on the slidable carrier that show a user where the insertion tool is to act during the installation, thus helping to avoid mistakes.

In another illustrative embodiment of the invention, and as shown in FIGS. 12 to 17, the insertion tool 16 provided by the slidable carrier 20 and the pusher member 21 can turn at each end of the slide housing 18. This embodiment has the same characteristics as the previous one described, but with the difference that there is only one slidable carrier and only one insertion tool, and some physical modification in the end of the slide housing to permit the slidable carrier to be rotated and turn freely through 360°. The insertion tool can be moved to one end of the slide housing, rotated through 180° and then moved back along the slide housing to connect wires to the other side of the magazine.

The pusher member 21 of the insertion tool 16 is the same as previously described above, but there are modifications, including firstly a cylindrical neck 56 (shown in FIG. 15) in the slidable carrier enabling it to turn freely in the end of the slide housing.

Figure 16:
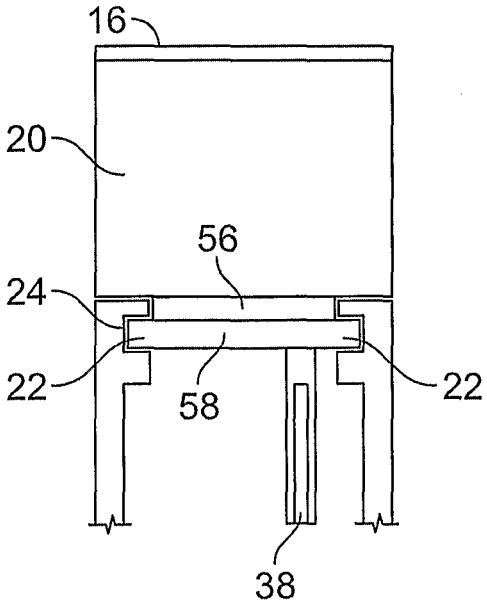
FIG. 16 is an end view of the tool shown in FIG. 15 at one end of its travel along the connector strip.
Figure 17:
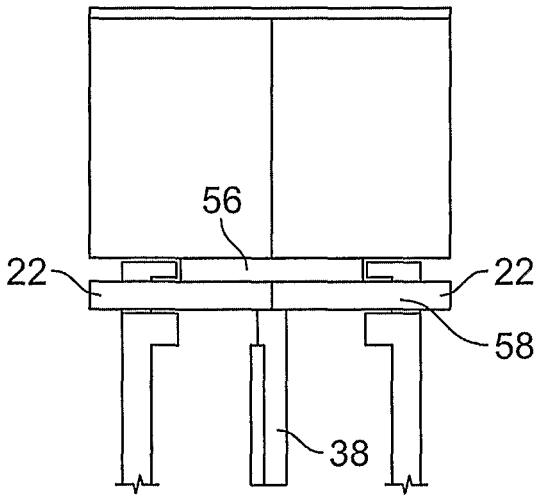
FIG. 17 is a view similar to that of FIG. 16 but showing the tool rotated through 45°.
Figure 18:
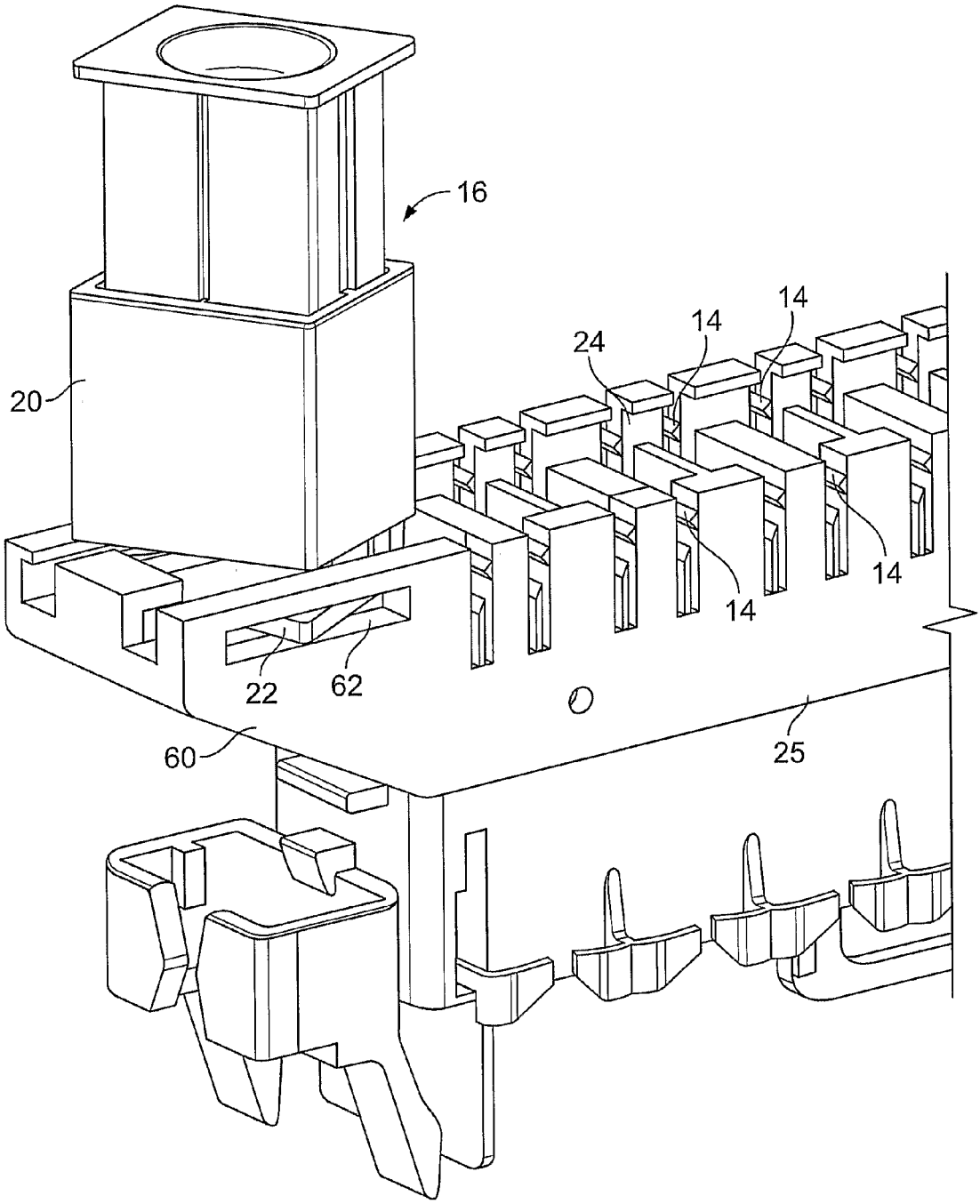
FIG. 18 is a perspective view of an end portion of the connector strip shown in FIG. 17 showing the manner in which a tool can be rotated thereon.
Figure 19:
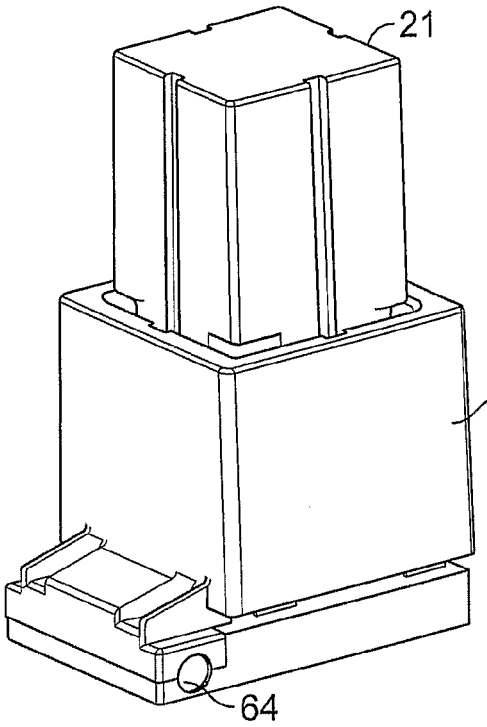
FIG. 19 is a perspective view of a further tool for use in a further embodiment of the present invention.
Figure 20:
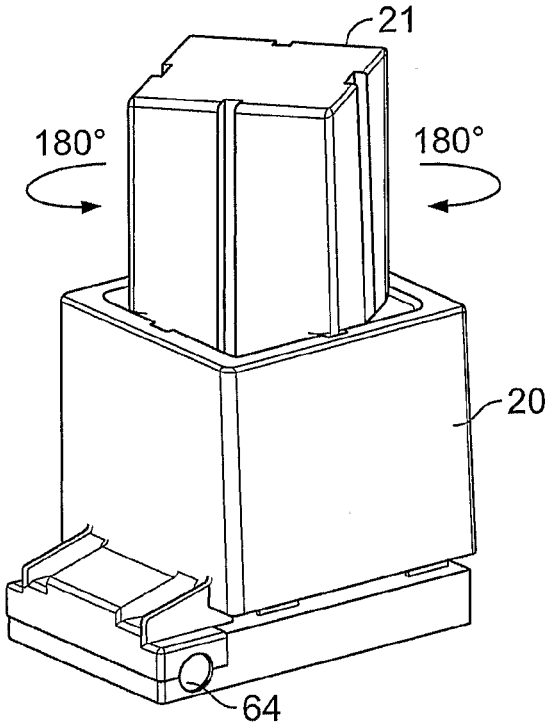
FIG. 20 is a view similar to that of FIG. 19 showing rotation of the tool of FIG. 19.

As shown in FIGS. 15, 16, 17 and 18, the slidable carrier 20 is formed with a square plinth or base portion 58 that provides the shoes 22 that slide along tracks provided by the guides 24 formed by the slide housing of the connector strip 12. At each end of the connector strip, the slide housing extends beyond the region in which the arrays of apertures 32 are located to provide wing-shaped extensions 60 (FIG. 18). Each extension has formed therein an elongate window 62 which is of a length such as to permit the tool to be rotated through 180° without slipping out of the slide housing, as shown in FIG. 18.

In a further illustrative embodiment of the invention, shown in FIGS. 19 to 24, the pusher member 21 can turn in whatever part of the slide housing because the pusher member turns with reference to the slidable carrier 20, and so can turn in any position of the slide housing because only the pusher member turns. It is not necessary to move the insertion tool to the end of the slide housing to turn the pusher member itself.

Figure 21:
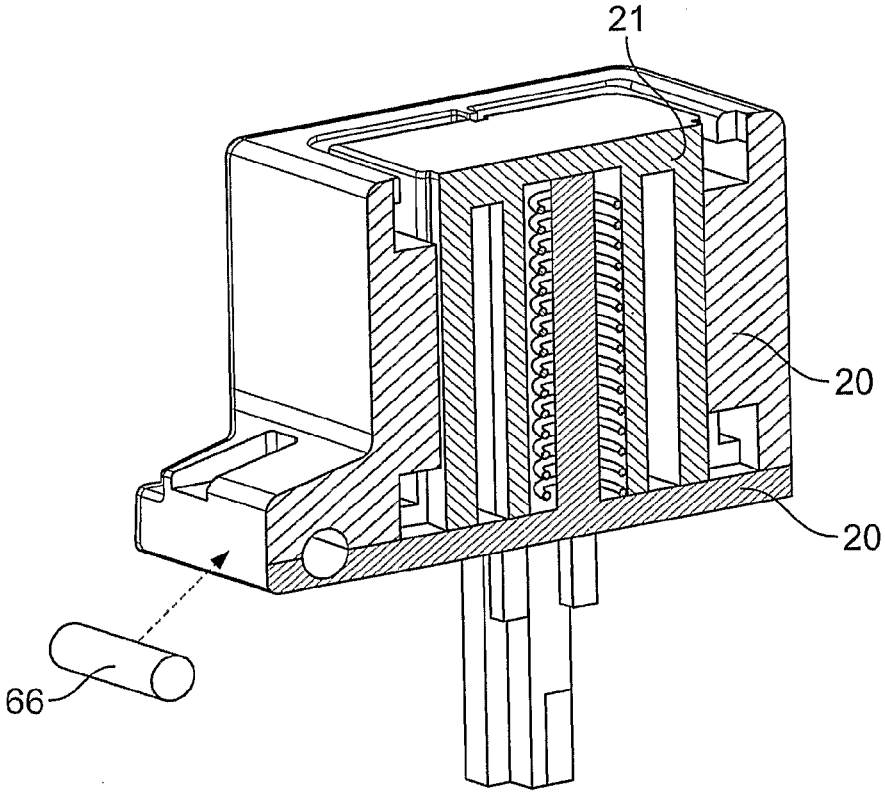
FIG. 21 is a perspective cutaway and sectional view of the tool of FIGS. 19 and 20.
Figure 22:
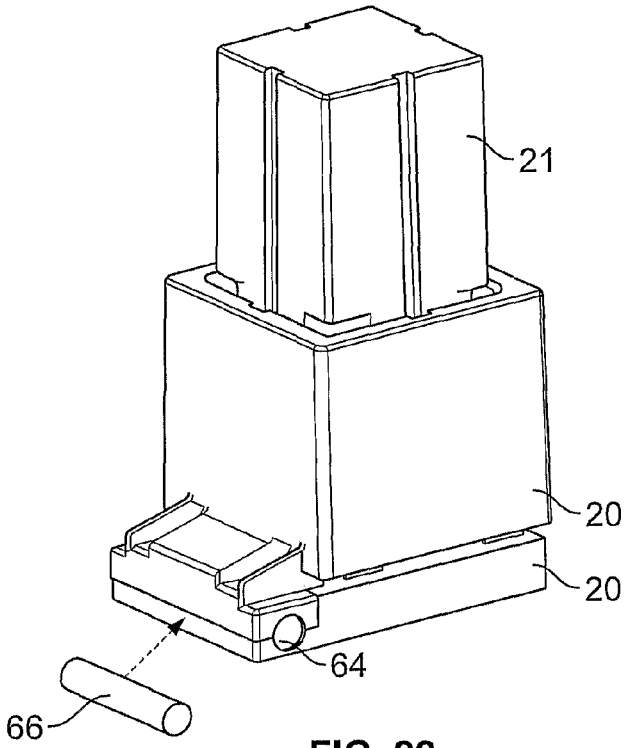
FIG. 22 is a perspective view of the tool shown in FIG. 21.
Figure 23:
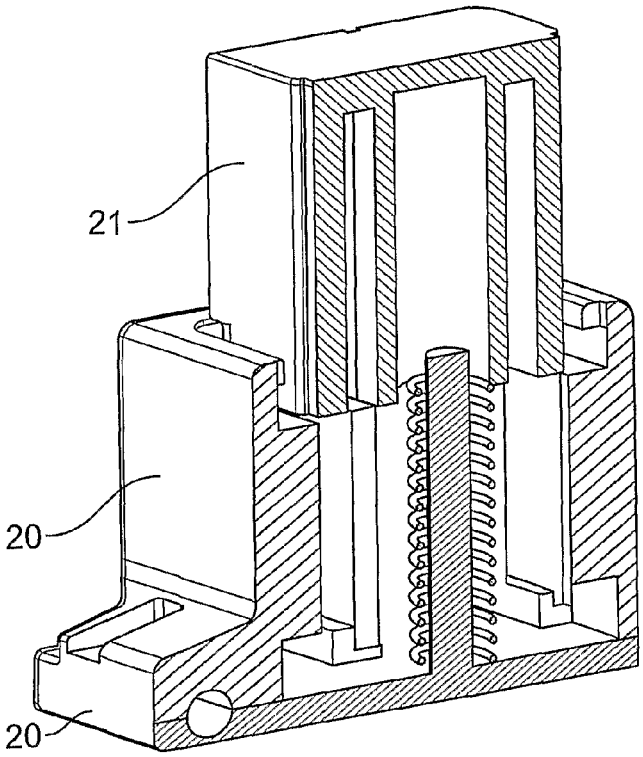
FIG. 23 is a perspective cutaway view of the tool shown in FIGS. 19 to 22.
Figure 24:
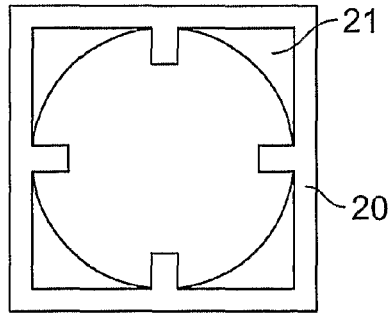
FIG. 24 is a sectional plan view of the tool shown in FIG. 21.
Figure 25:
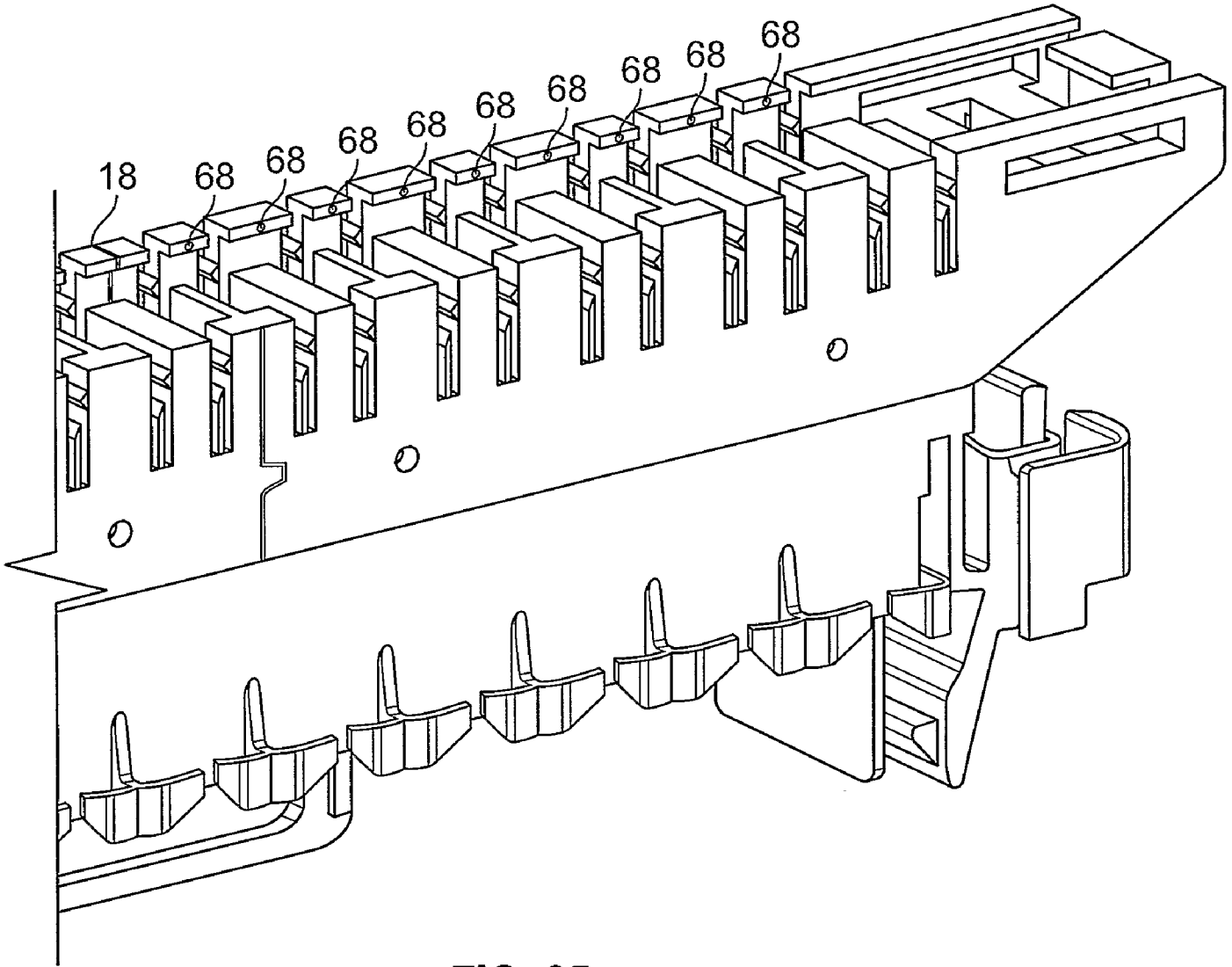
FIG. 25 is a perspective view of an end portion of a connector strip of another electrical connector according to a further embodiment of the present invention having a further insertion tool mounted thereon.

In this embodiment, the carrier 20 incorporates two detent balls 64 mounted in sockets therefor and biased apart by a spring 66. As shown in FIGS. 21 and 22, the spring is located in a lateral housing provided by a two-part carrier 20. The two balls are arranged to engage in hollows 68 (FIG. 25) on inner faces of each upstanding side of the slide housing 18, as shown in FIG. 25. As the slide carrier moves between the sides of the slide housing, the two balls ride along their surfaces and are urged into the hollows 68. The force of the spring is such that engagement of the balls in the hollows can be overcome by manually urging the slide carrier along the strip. However, engagement of the balls in the hollows is sufficient to notify a user that any desired position has been reached.

The functionality of the insertion tool is the same as with previous embodiments, as can be seen from FIGS. 21 and 22.

Figure 26:
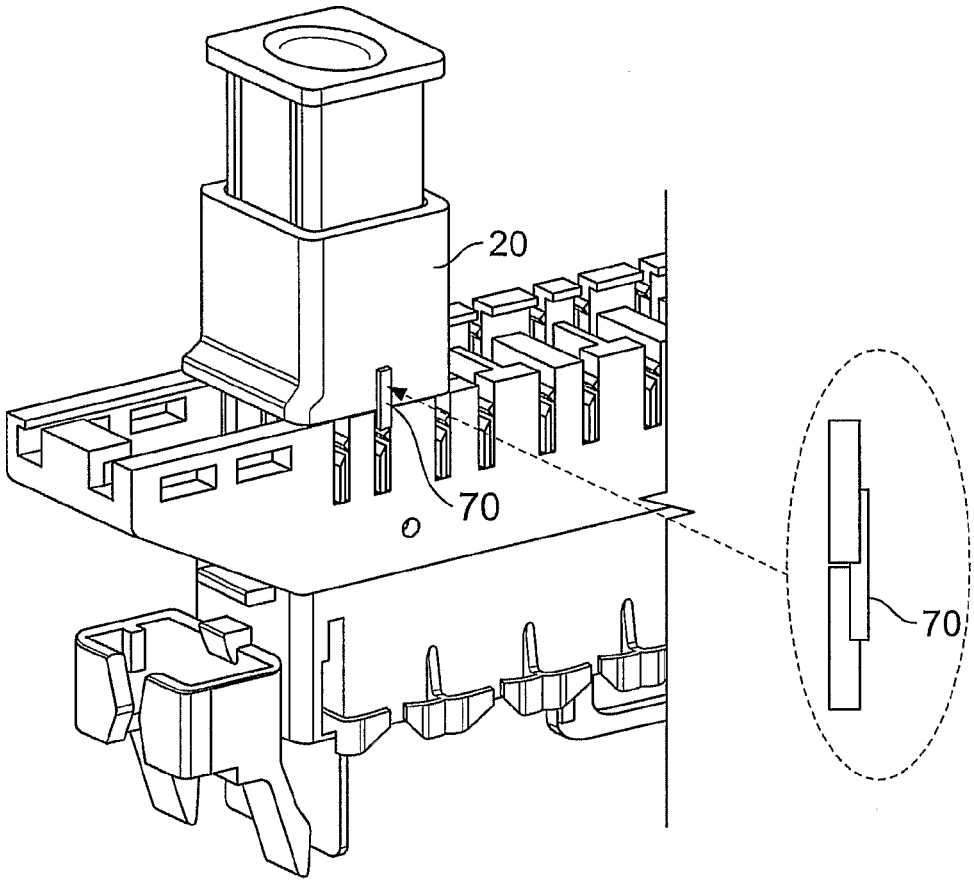
FIG. 26 is a perspective view of the further insertion tool shown in FIG. 25.
Figure 27:
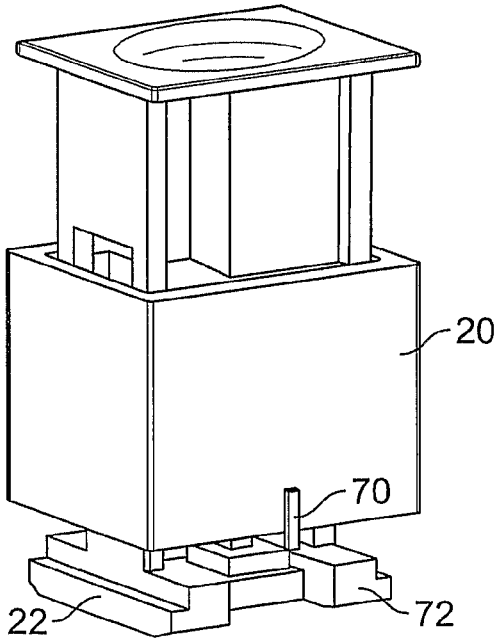
FIG. 27 is a perspective cutaway view of the tool shown in FIGS. 25 and 26.
Figure 28:
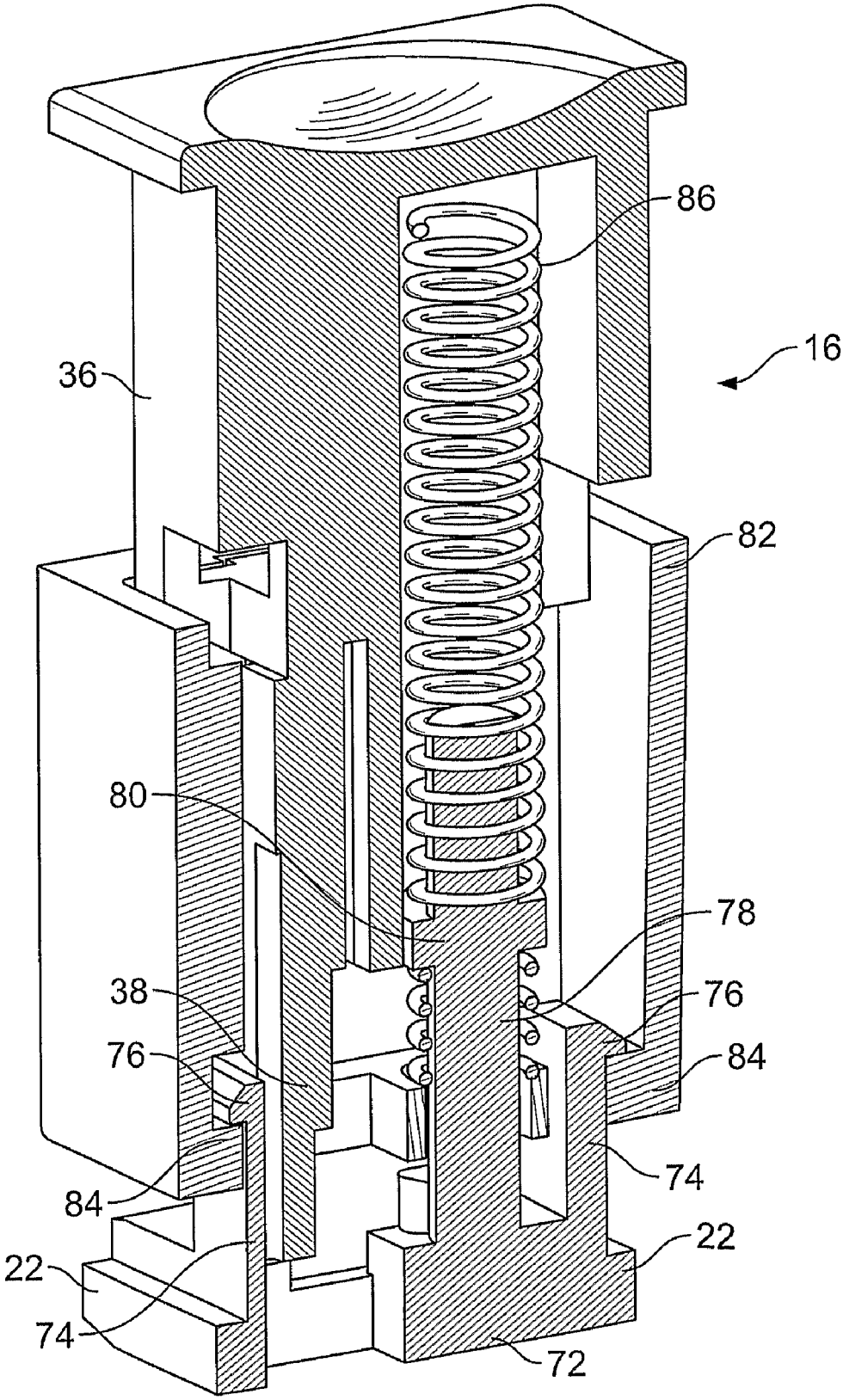
FIG. 28 is a perspective view of an end portion of a connector strip adapted to accommodate the tool shown in FIGS. 25 to 27.

A further embodiment of the invention is shown in FIGS. 26 to 28. This embodiment employs a visible means of indicating and assuring that a slidable carrier is in a desired position for connecting a wire. The slidable carrier 20 is formed with a rib 70 on each side of the carrier though only one is shown in the Figures. The ribs can be formed as plastics protrusions during moulding of the carrier or may be bonded thereto. Each rib may be formed with a curved surface facing the sides of the slide housing so that, under the influence of manual urging of the carrier along the strip, the ribs can engage in apertures along the sides but can readily be disengaged therefrom if required. To this end, as shown in the inset to FIG. 26, the portion of the rib that engages in any aperture along the strip can be of minimal thickness in order to indicate to an installing engineer that engagement has occurred. However, in a preferred form of this embodiment of the invention, each plastic rib is of sufficient rigidity as to provide a physical stopper to assure the position during the connection. To this end, and to change the position of the slidable carrier, a different construction is required.

The slidable carrier of the insertion tool is formed in two parts, as shown in FIG. 28. In this embodiment, the slidable carrier comprises a base portion 72 which is formed as a one-piece moulding providing shoes 22 whereby the carrier is entrained to slide in guides 24 as with previous embodiments.

The base portion 72 further includes a pair of upright flats 74 each of which has an outwardly extending detent 76 for the purpose hereinafter described. Centrally of the base portion is an upstanding pillar member 78 which has an integrally formed circular flange or platform 80 approximately three fifths of its height above the base portion 72. A vertically movable sleeve 82 of substantially square cross-section is mounted on the base portion 72, the sleeve having internally extending feet 84 arranged to engage under the detents 76. The sleeve is slidable between its upper limit of its movement determined by engagement of the detents 76 with the feet 84 and the lower limit of movement determined by engagement with the shoes 22. However, when the carrier is mounted in a connector strip, the lower limit of movement is determined by engagement with upper surfaces of the guides for the shoes 22. Within the sleeve 82 is mounted a pusher member 36 which, like the base portion 72, is formed as a one-piece moulding and is shaped to slide within the sleeve 82. Between the top of the pusher member and the platform 80 of the pillar 78, a coiled spring 86 is positioned on the pillar to bias the pusher member upwardly to a rest position as shown in FIG. 28. The insertion tool also comprises a cutting blade 38 which is substantially similar to those of earlier embodiments of the invention.

As can be seen from FIG. 28, relative movement is possible between the two parts, i.e. the base portion 72 and the sleeve 82 of the slidable carrier, to permit movement of the sleeve upwardly while the base portion is retained in the slide housing. When the sleeve rises, the plastic rib 70 is released from the slot of the slide housing so that the slidable carrier can be moved along the slide housing until the next position, where it will be released and drop down automatically.

The function of the spring is twofold, as shown in FIG. 28:

1.—It raises the insertion tool automatically

2.—it permits the plastic rib to drop into the slot of the slide housing just releasing the sleeve of the slidable carrier after it has been raised to permit movement along the slide housing.

Figure 29A:
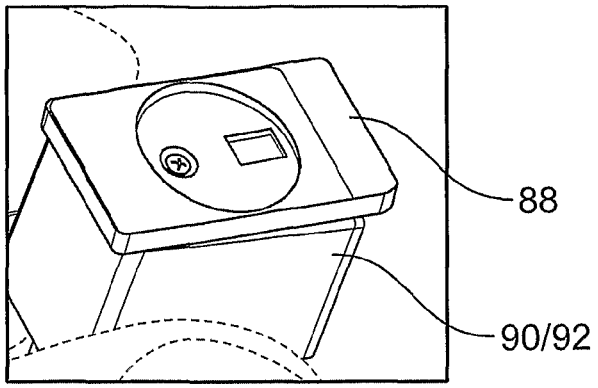
FIGS. 29A to 29C are photographs showing the manner in which an insertion tool can be rotated when it is at any position along the length of a connector strip.
Figure 29B:
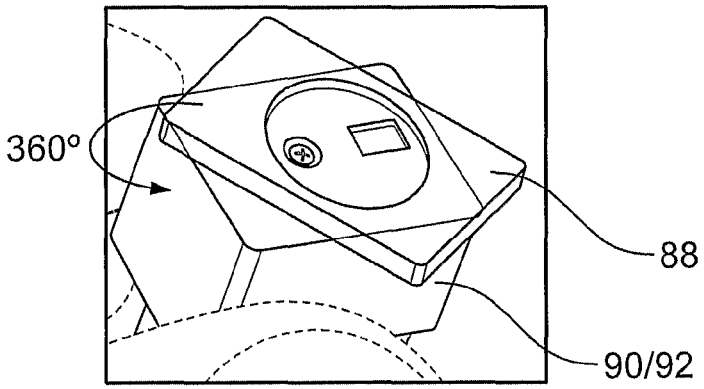
Figure 29C:
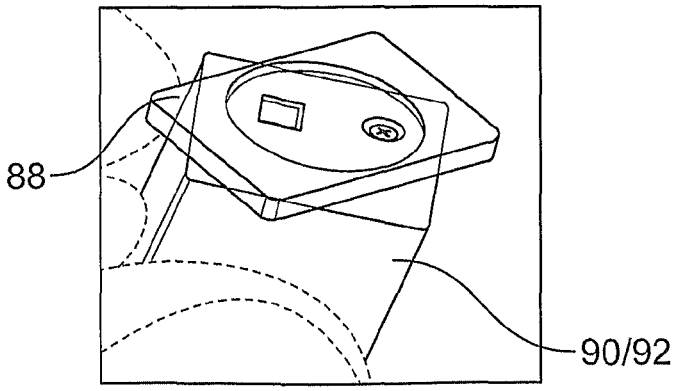

Referring now to FIGS. 29A to 29C, there are shown photographs of a further embodiment of the present invention which is designed and constructed so that the insertion tool can be rotated wherever its associated slidable carrier is positioned on a connector strip. The slidable carrier 20 comprises two parts, a first 88 of which is in the form of a flat rectangular plate which provides shoes whereby the plate can slide in guides 24 as with the previous embodiments. A second part 90 of the carrier is pivotally coupled to the first part and provides a sleeve 92 for the insertion tool 16 (not shown) in a manner similar to that described with reference to FIG. 28. These photographs illustrate that the material from which the insertion tool is made can be transparent. It can be advantageous to form the tool, or parts thereof at least that would otherwise visually obscure an engineer's view of wire insertion, of transparent material so that connection of wires into the connector strip can be closely monitored.

As an alternative to use of transparent material for this purpose, it is also possible to form the top part of the insertion tool so that it is open to provide an inspection port through which proper connection of the wires can be viewed.

As with the previous embodiments of the invention, ball and spring arrangements can be employed to indicate positive positioning.

Figure 30:
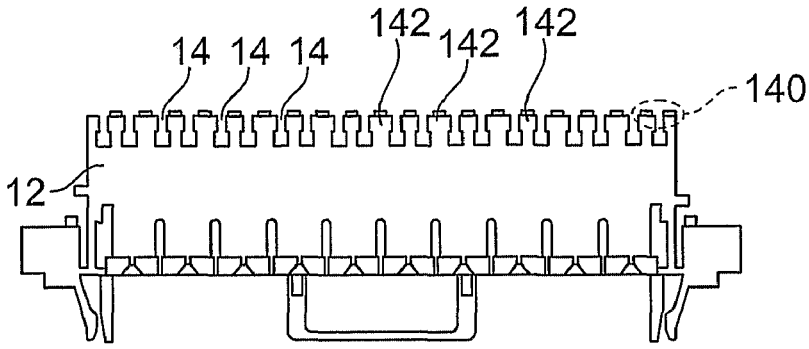
FIGS. 30, 31 and 32 are side, perspective and end views of a connector strip of an electrical connector according to another embodiment of the present invention.
Figure 31:
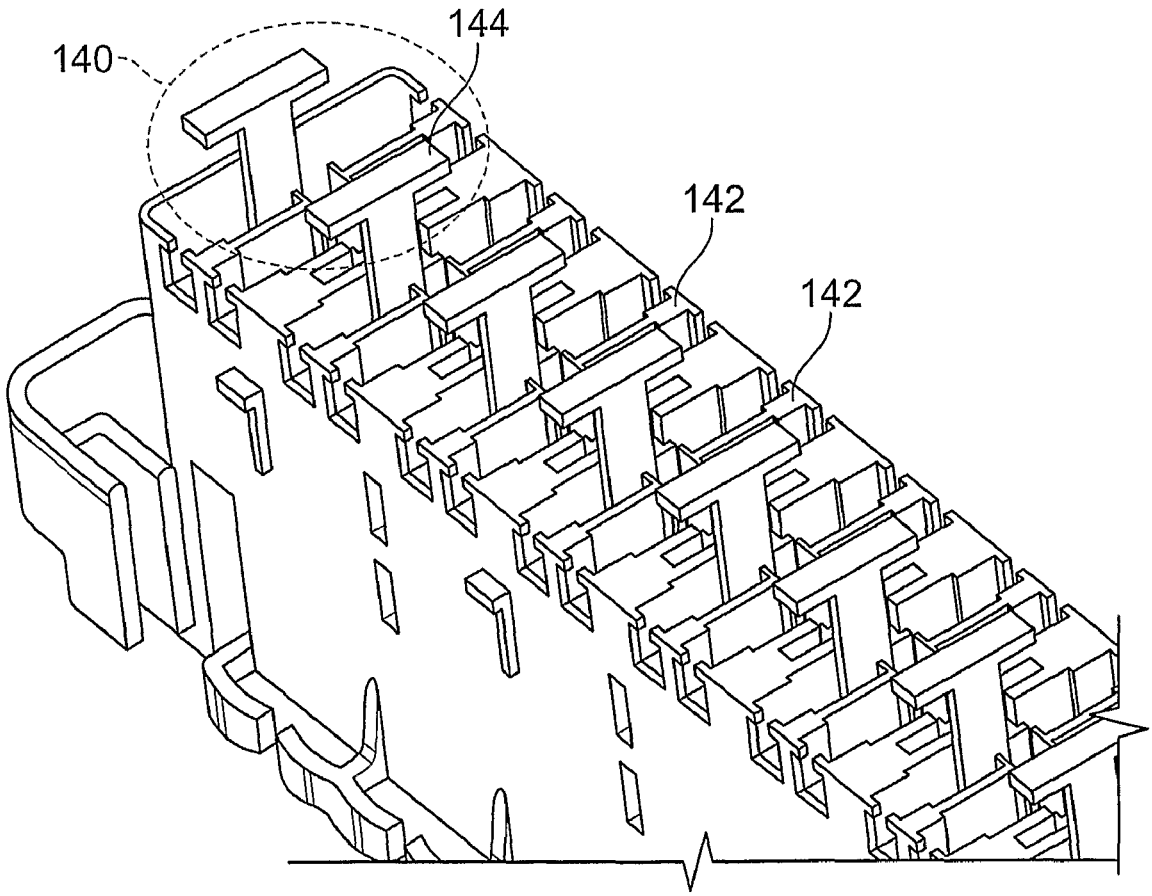
Figure 34:
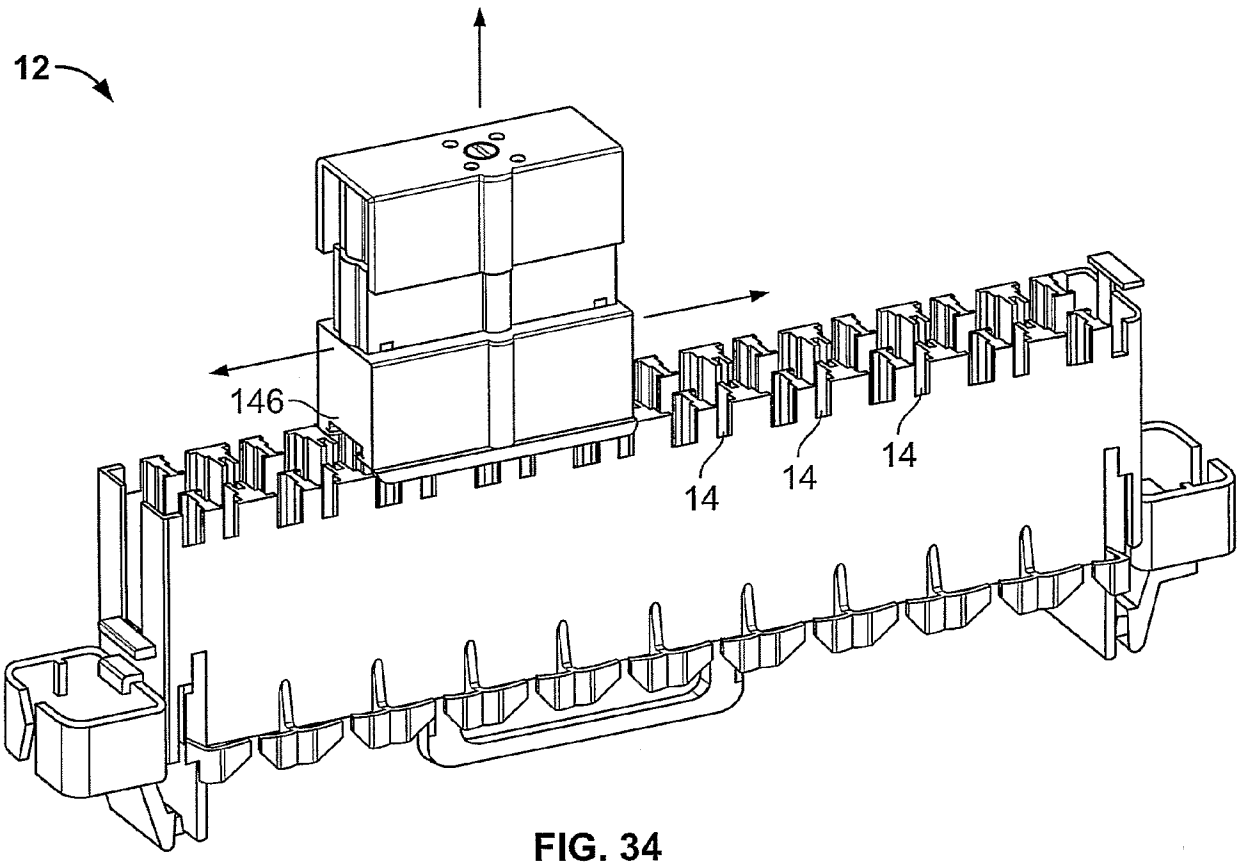
FIGS. 34 and 35 are perspective views of the electrical connector of FIGS. 30 to 32 having the tool shown in FIG. 33 mounted thereon.
Figure 32:
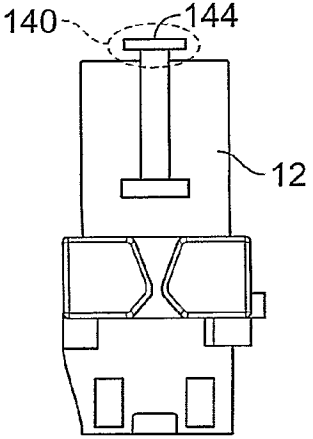
Figure 33:
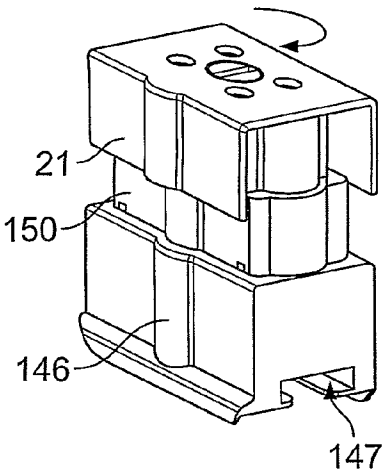
FIG. 33 is a perspective view of a tool for use with the connector strip of the connector shown in FIGS. 30 to 32.
Figure 35:
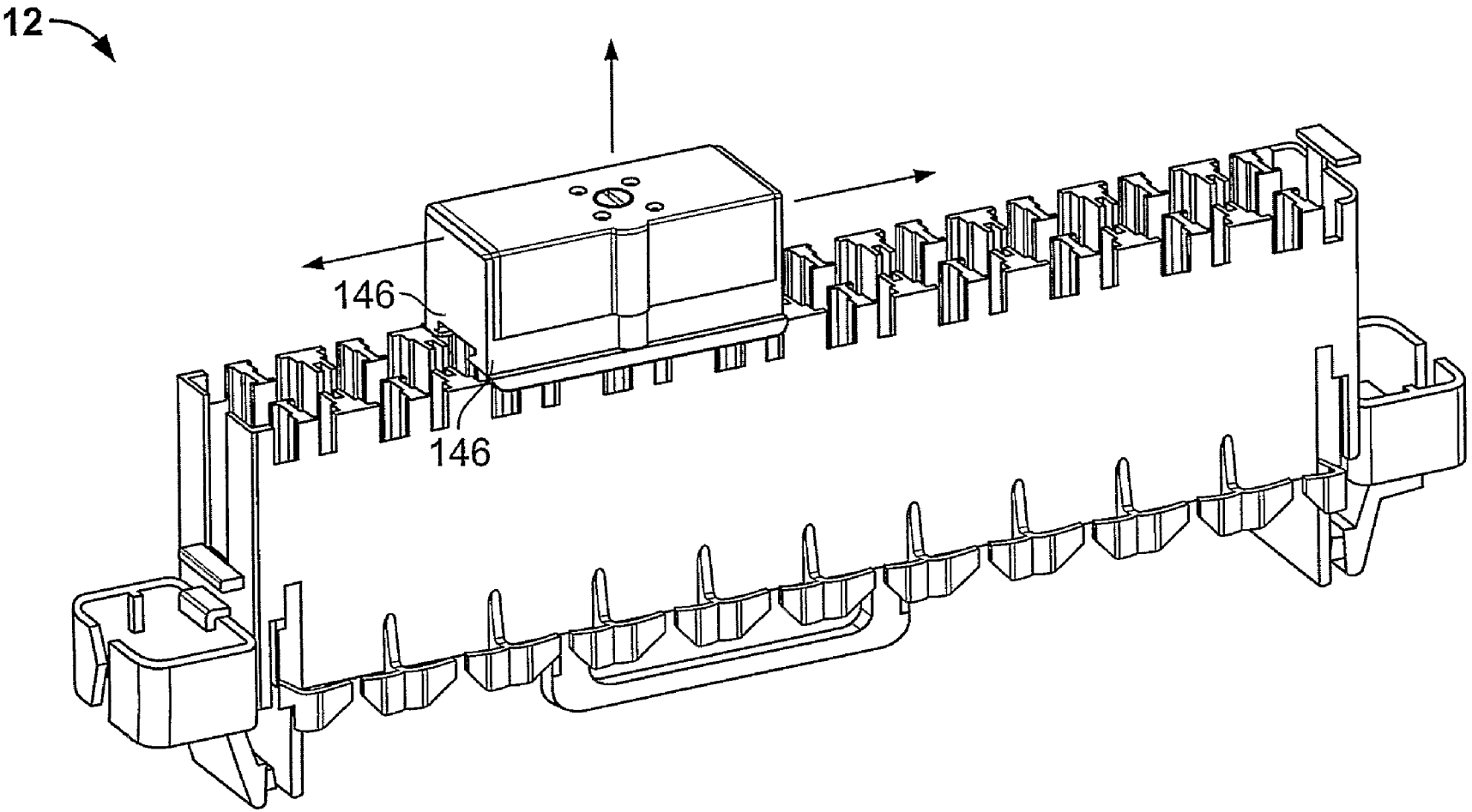

Referring now to FIGS. 30 to 37, there is illustrated therein a further embodiment of the present invention in which a single wire pusher member 21 is mounted on a slidable carrier on only one guide provided by a row of segments, hereinafter referred to collectively as a rail or track 140, circled in FIGS. 31, 32 and 33, preferably in the central part of the connector strip, instead of two guides on the respective sides of the strip as with the preceding embodiments.

In this embodiment, the connector strip 12 is formed to permit pairs of wires to be coupled to the strip in the same manner as in the preceding embodiments, each wire of a pair being pressed laterally into an aperture 14 containing a respective connector terminal (not shown). Adjacent apertures are separated one from the other by transverse partitions 142, alternate ones of which are surmounted by an integral planar rectangular segment 144 which is spaced from but aligned with like segments of the other transverse partitions. The segments of the plurality of segments are sufficiently closely spaced that they form the aforementioned rail 140 along a central part of the connector strip. This is shown in FIGS. 30 to 32. Each segment has a rectangular shaped cross section.

Figure 36:
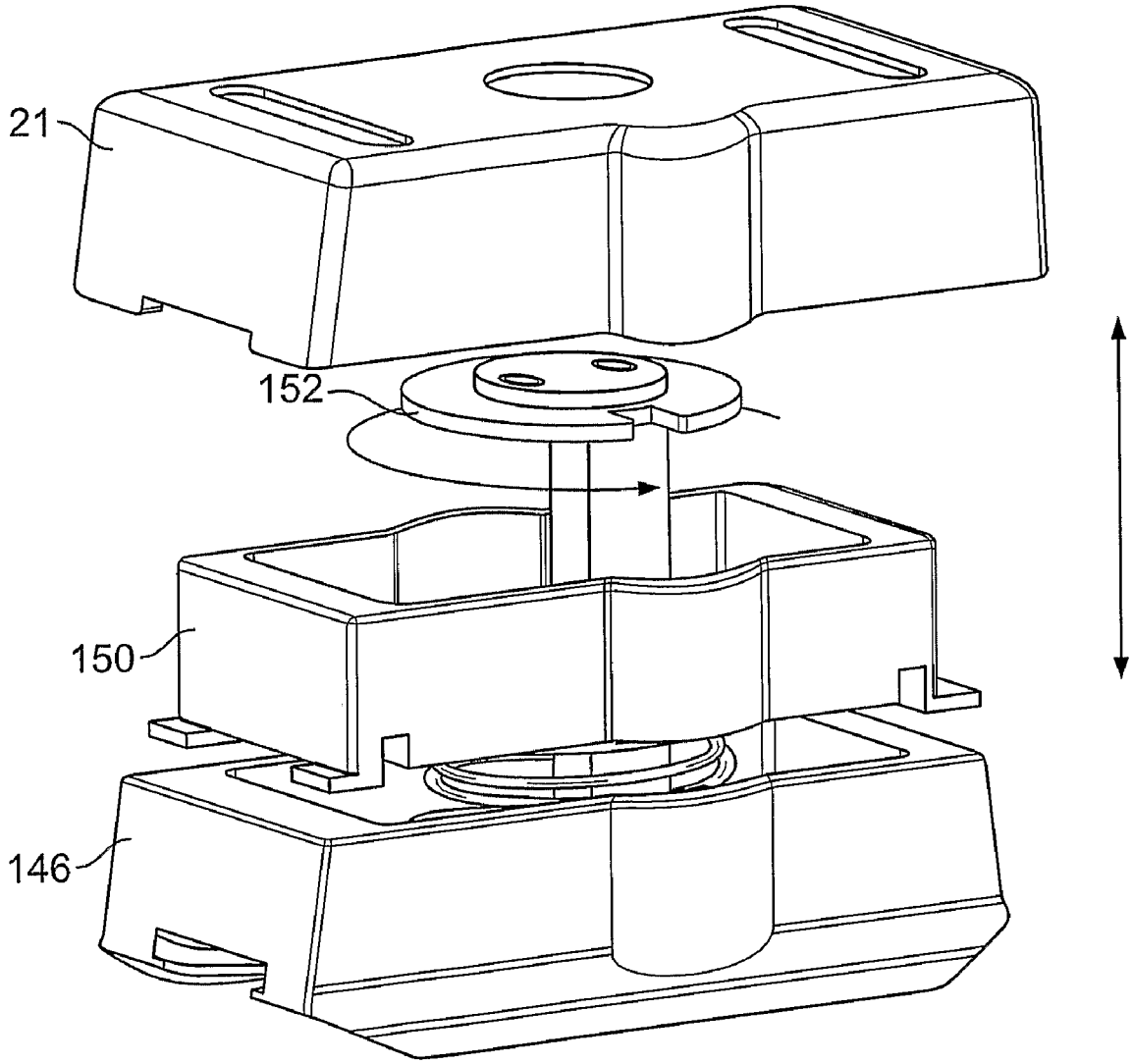
FIG. 36 is an exploded view of the tool shown in FIG. 33.
Figure 37:
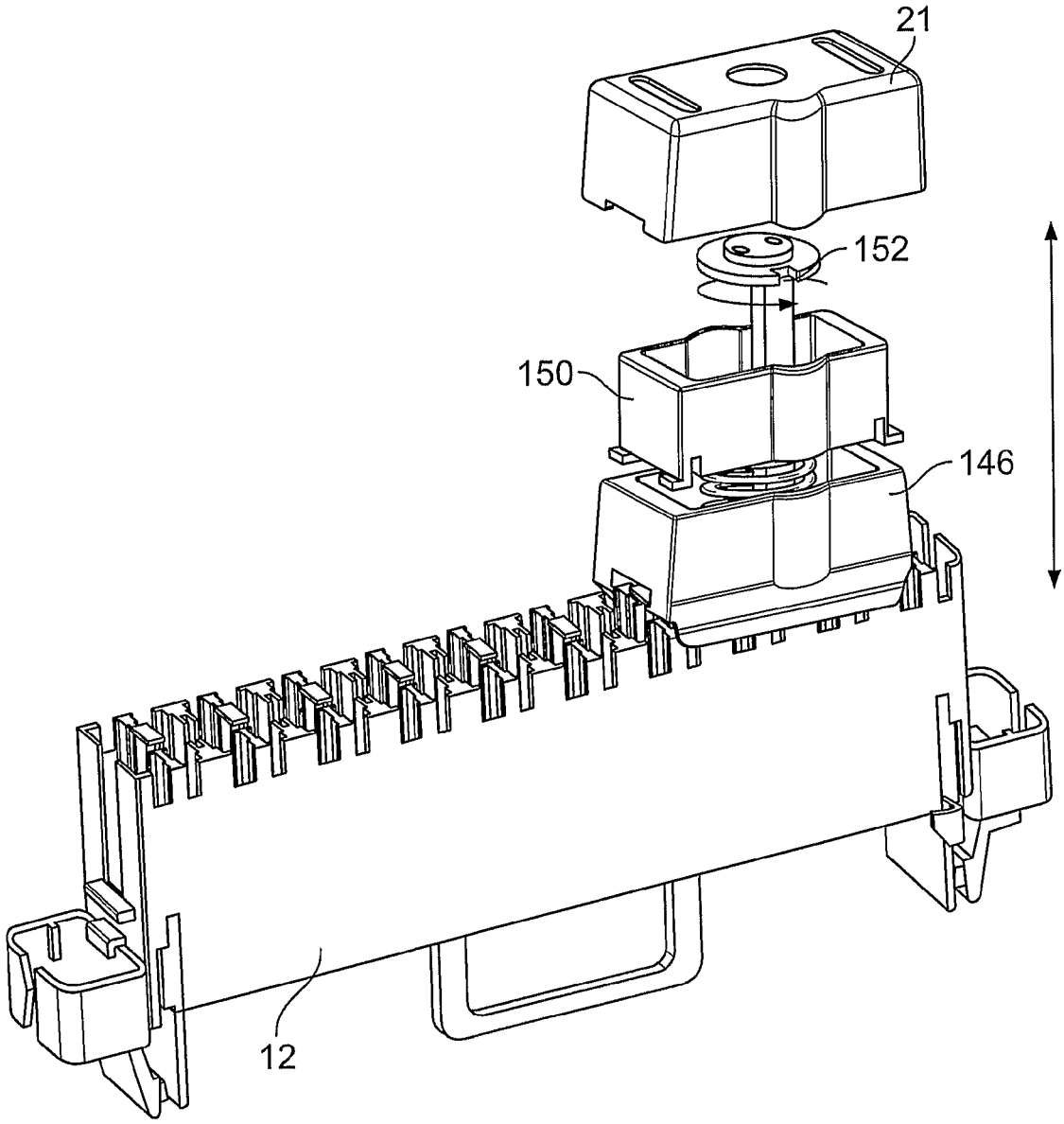
FIG. 37 is a partially exploded view showing the tool of FIG. 36 mounted on the connector strip shown in FIGS. 34 and 35.

The carrier 146 is rectangular in section and is formed as a one-piece moulding having guides 147 which are complimentary in shape to the profile of the segments 144, as can be seen in FIGS. 33, 36 and 37, so that the guides can engage with the rail formed therefrom.

Figure 7:
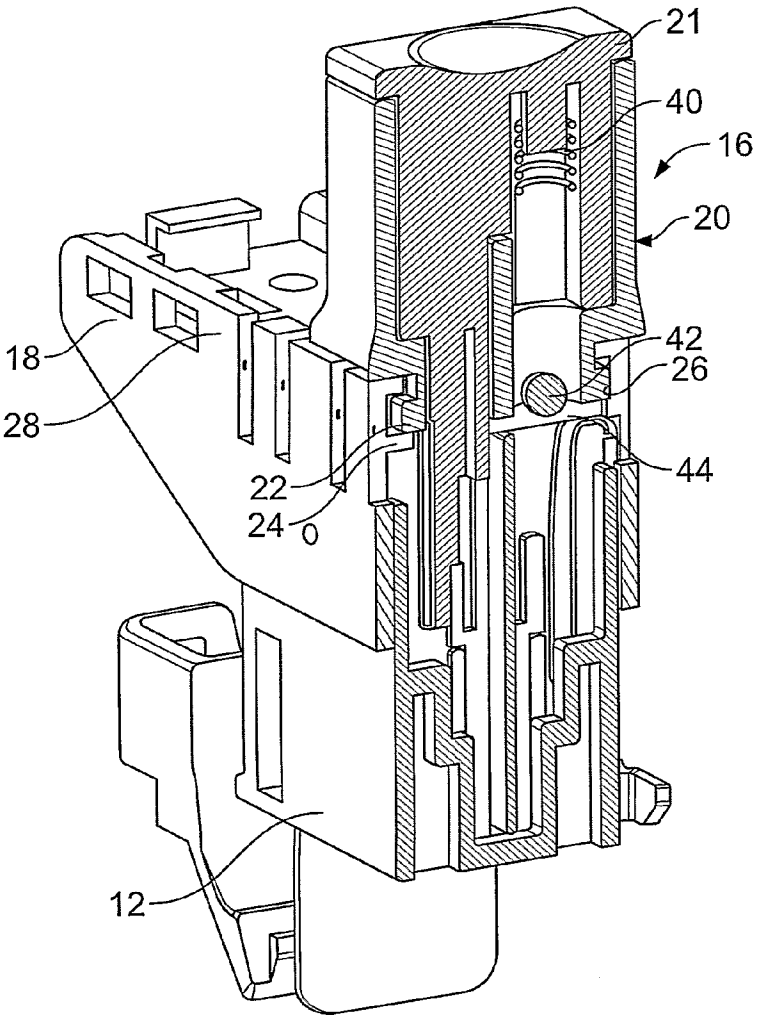
FIG. 7 is a further partially cutaway view of an end portion of a connector strip and of a tool fitted thereto showing the interaction of the tool with the strip.

The pusher member is mounted in the slidable carrier 146 in a similar manner to the construction shown in FIG. 7 and could be provided with two or more insertion members to insert wires into the connector on both sides of the central rail, but, for lower cost and ergonomic reasons, the tool may preferably be constructed with a single pusher member arranged for rotation on the rail to insert wires selectively on one side or the other.

The insertion tool of this embodiment can readily be seen by comparison with Figures illustrating the preceding embodiments to be larger than those insertion tools. Increased size permits connection of the wires with the thumb or with the palm of the hand to facilitate installation. This improves the installation ergonomics and reduces the risk of "thumb soreness" to which installation engineers are prone. This embodiment permits connection of the wires on both sides of the connector with only one insertion tool. In this embodiment, only the central part of the insertion tool is required to turn 180° in both directions to align the insertion tool in the appropriate connection terminal to connect.

As can be seen particularly from FIGS. 36 and 37, the insertion tool shown in FIGS. 33 to 37 is formed in four parts comprising the slidable carrier 146, an insert 150, an elongate pusher member 21 and a pivotal turret 152 mounted within the assembly of carrier, insert and pusher member. The turret 152 is mounted to allow rotation thereof to permit the insertion tool to be rotated so that wires on one side or the other of the connector strip can be connected and then the insertion tool rotated to connect wires on the opposite side of the strip.

While the embodiment of FIGS. 30*m* to 37 has been described with reference to the use of a single insertion tool, it will be readily appreciated from an understanding of the preceding embodiments that it would be possible to use two tools. Furthermore, though this embodiment has been explained by reference to an insertion tool which can be rotated while it is between the ends of the connector strip on which it is mounted, it is foreseen that the slide housing may be extended as shown for example in FIG. 26 so that individual tools can be moved to 'inoperative' positions altogether, and can, if desired, be rotated at either end of the strip.

The embodiment shown in FIGS. 38 to 44 is in some aspects similar to that illustrated in FIGS. 12 to 18 and in others similar to that illustrated in FIGS. 30 to 37.

The connector strip 12 is, in this embodiment, formed with adjacent apertures separated one from the other by transverse partitions 160, 162. These transverse partitions alternate and are of two basic types. The partitions 160 are formed as planar plates which have a vertically extending slot 164 separating at least their uppermost portions while the partitions 162 are thicker than the partitions 160, are recessed at their centers 166 and have a transverse slot 168 formed therein.

Side walls 170 of the connector strip are formed with slots 172 on each side of the partitions 160 to accommodate wire end portions (not shown) for attachment to the strip.

The transverse slots 168 are deep enough to accommodate track members 174, described below. The slots are undercut below upper surfaces of the partitions 162.

The track members 174 are each formed as a one-piece moulding of rigid plastics material and comprise a planar upper portion 176 which is supported on an integral lower body portion 178. Extending laterally, i.e. in the direction of the connector strip length, of the upper portion and body portion are pairs of fins 180.

Below the planar portion 176 and formed integrally with the planar portion and the body portion are clip portions 182 which extend outwardly of the body portion 178 and include lugs 184.

The track members 174 are mounted on the partitions 162 by insertion of the clip portions into the transverse slots 168. To this end, the clip portions are sufficiently resilient that they can be pinched together for such insertion and then released to engage in the undercuts of the upper surfaces of the partitions 162.

When the track members are all mounted on their respective partitions, they are sufficiently closely spaced that they form a track or rail 140 along and above a central part of the connector strip. The track members can, if damaged or for any other reason, be removed by insertion of a tool through apertures 186 in side walls of the strip to compress the clip portions and allow their release from the partitions 162.

Along this track or rail 140 can move a slidable carrier 188 of an insertion tool 189 which carrier is similar to the slidable carrier shown in FIG. 36 in so far as it slides above the strip. To this end, the slidable carrier has a base portion or plinth 190 which has a wedge shaped groove providing a guide 192, similar to that shown in FIG. 33, formed in its underside which is complementary in shape to that of the cross section of the track members 174 so that it can slide on the track 140 without becoming disengaged therefrom. Integral with the base portion 190 is a cylindrical portion 194 which provides an annular recess 196 in which sits a flange portion 198 of a sleeve 200 arranged so that the sleeve can rotate relative to the base portion 190.

Within the sleeve 200 is mounted a pusher member 202 similar to the pusher member 21 of FIG. 18 except that the pusher member 202 is not formed with the overhang shown in FIG. 18. In so far as the construction and design of the member is similar to that shown in FIG. 18, no further description is required.

Figure 15:
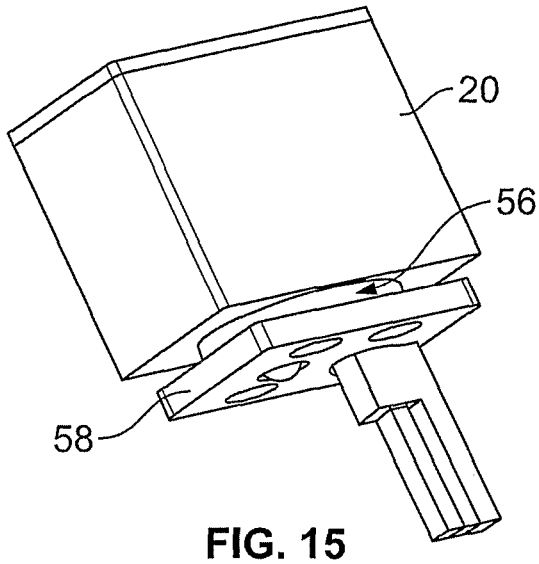
FIG. 15 is a perspective view showing detail of the rotatable tool shown in FIGS. 12 to 14.

The insertion tool has a pusher member and cutting blade (not shown in the drawings) which are similar to that described and illustrated with reference to FIGS. 15 to 17 and will therefore not be further described.

In a further embodiment of the invention, the insertion tool may be fitted with two pusher members and associated cutting blades so that adjacent pairs of wires may be cut and inserted simultaneously, thereby reducing the time required to load the wires into the strip.

Figure 44:
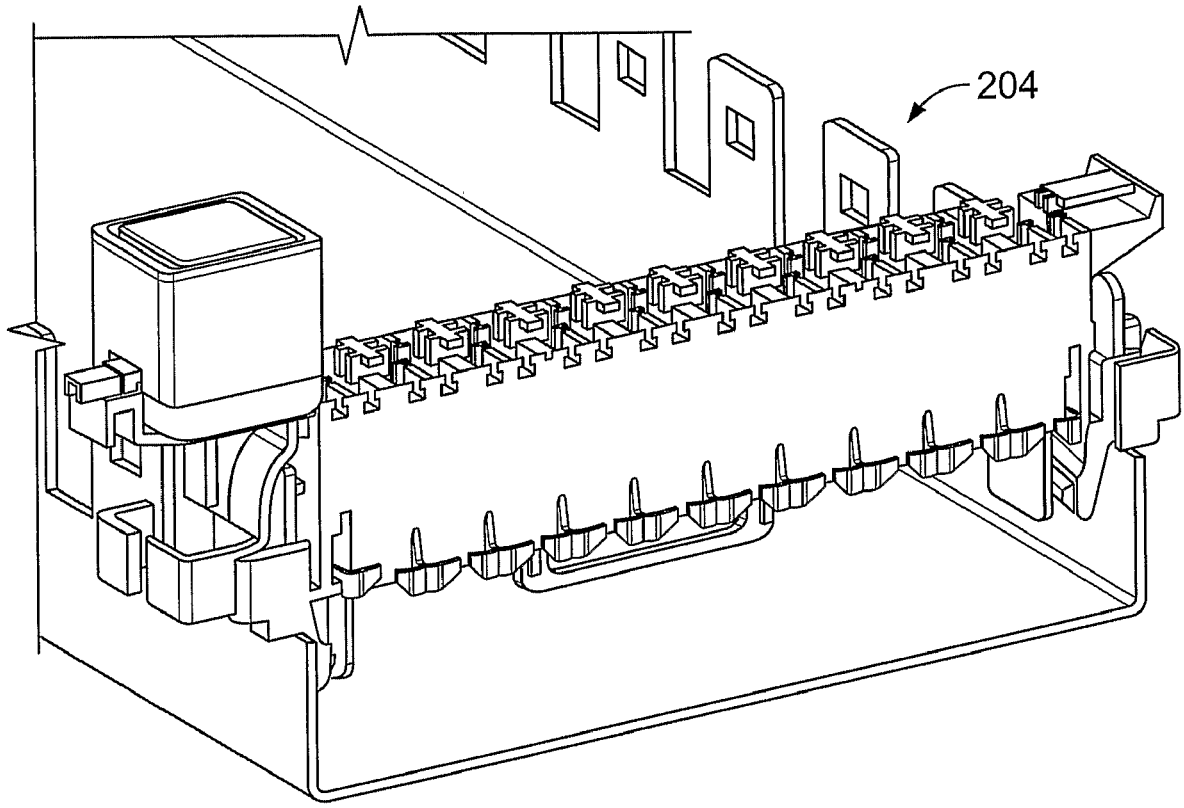
FIG. 44 is a perspective view illustrating the manner in which a connector according to the present invention is mounted in a chassis therefor.

FIG. 44 is a perspective illustration of an electrical connector according to the present invention mounted in a chassis 204 such as can be found in a telephone sub-station. Though FIG. 44 illustrates the use of an electrical connector of the type shown in FIGS. 38 to 44, it will be readily understood by a man skilled in the art that each of the embodiments of the present invention will be similarly mountable.

Figure 38:
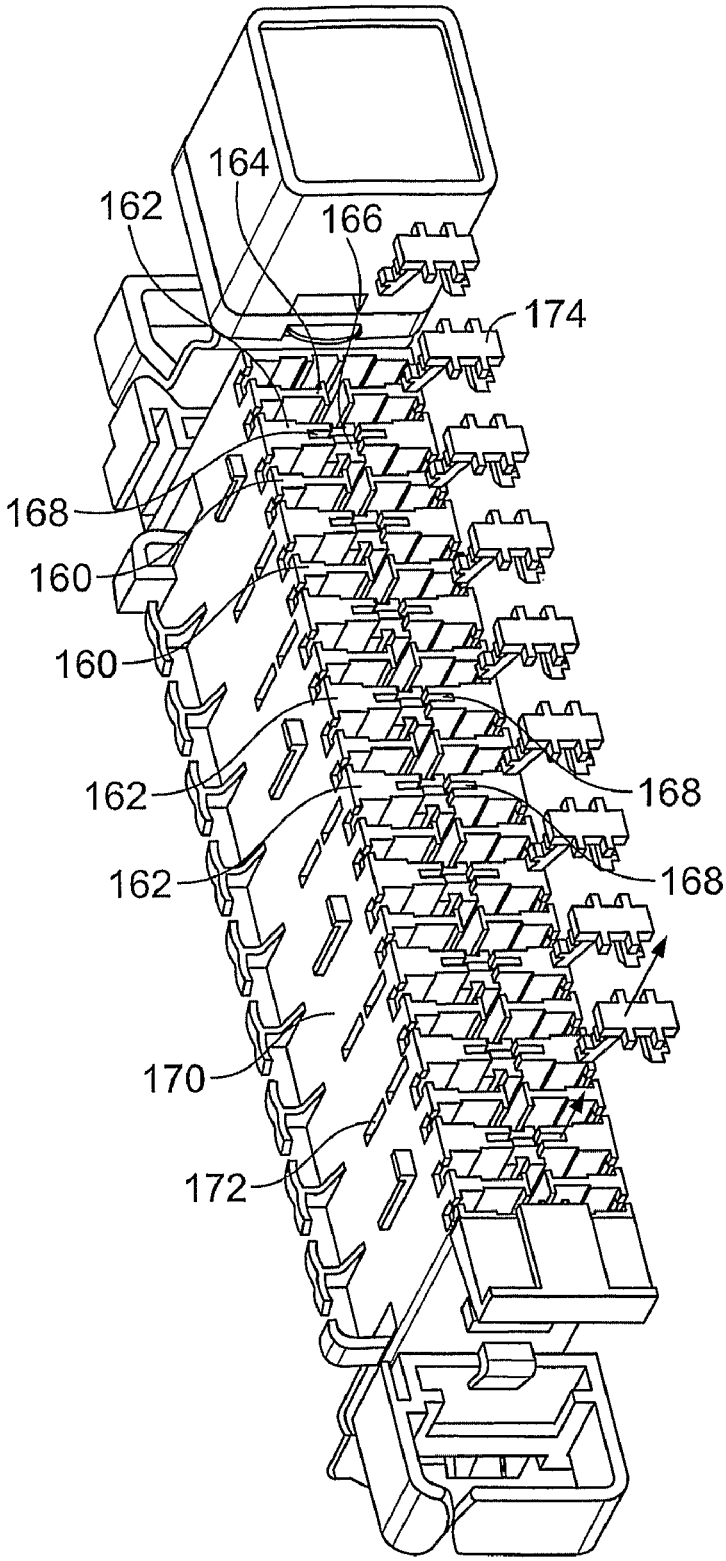
FIG. 38 is a perspective view of an electrical connector according to a further embodiment of the present invention showing the manner in which an insertion tool can be deployed during connection of wire pairs thereto.
Figure 38A:
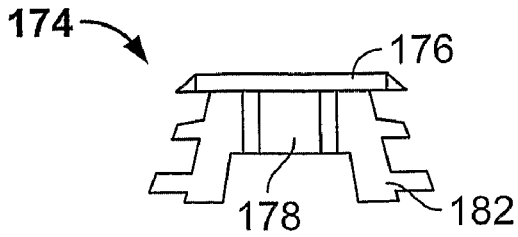
FIGS. 38A and 38B are side and plan views respectively of a part of the connector strip of the connector shown in FIG. 38.
Figure 38B:
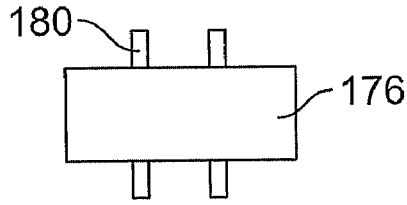
Figure 39A:
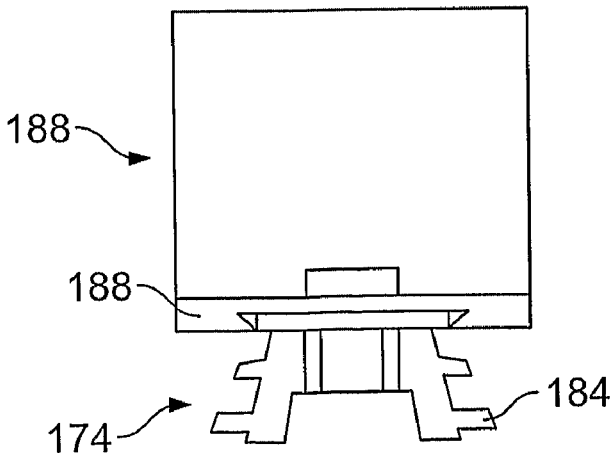
FIG. 39A is an end view of the tool shown in FIG. 39.
Figure 39:
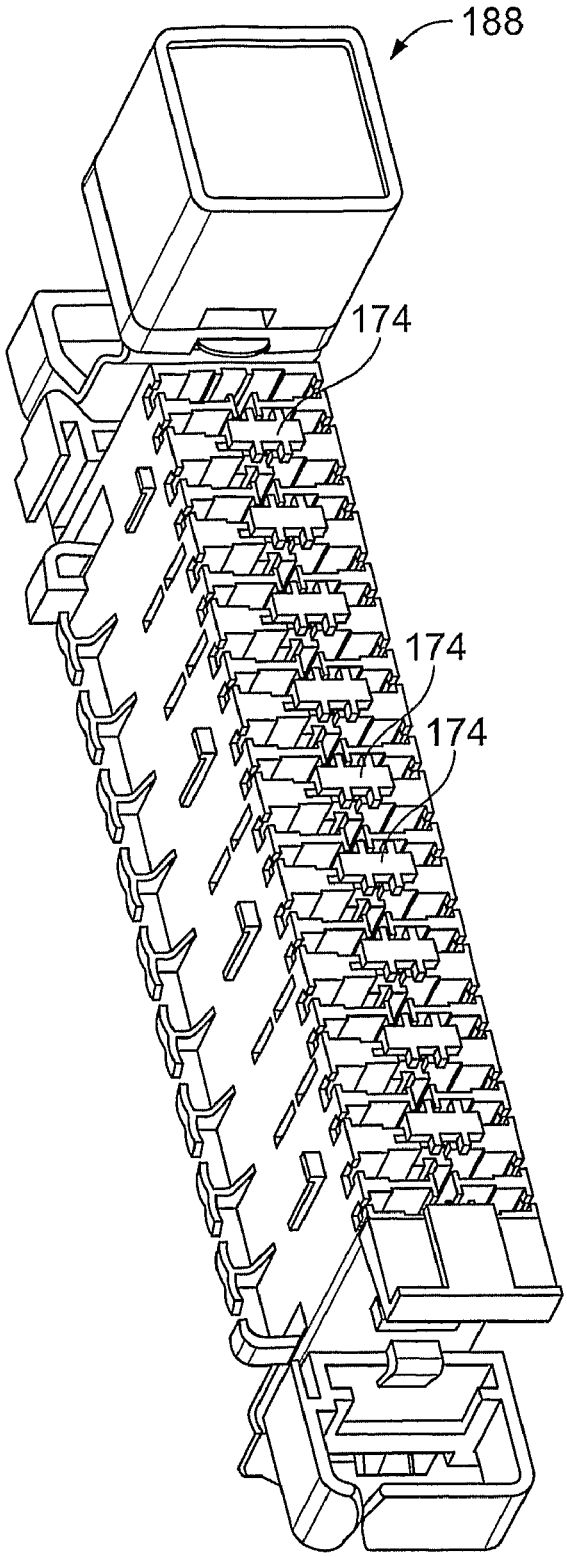
FIG. 39 is a further view of the electrical connector of FIG. 38 showing the assembly of the connector and the manner in which it can be used to secure wire pairs thereto.
Figure 40:
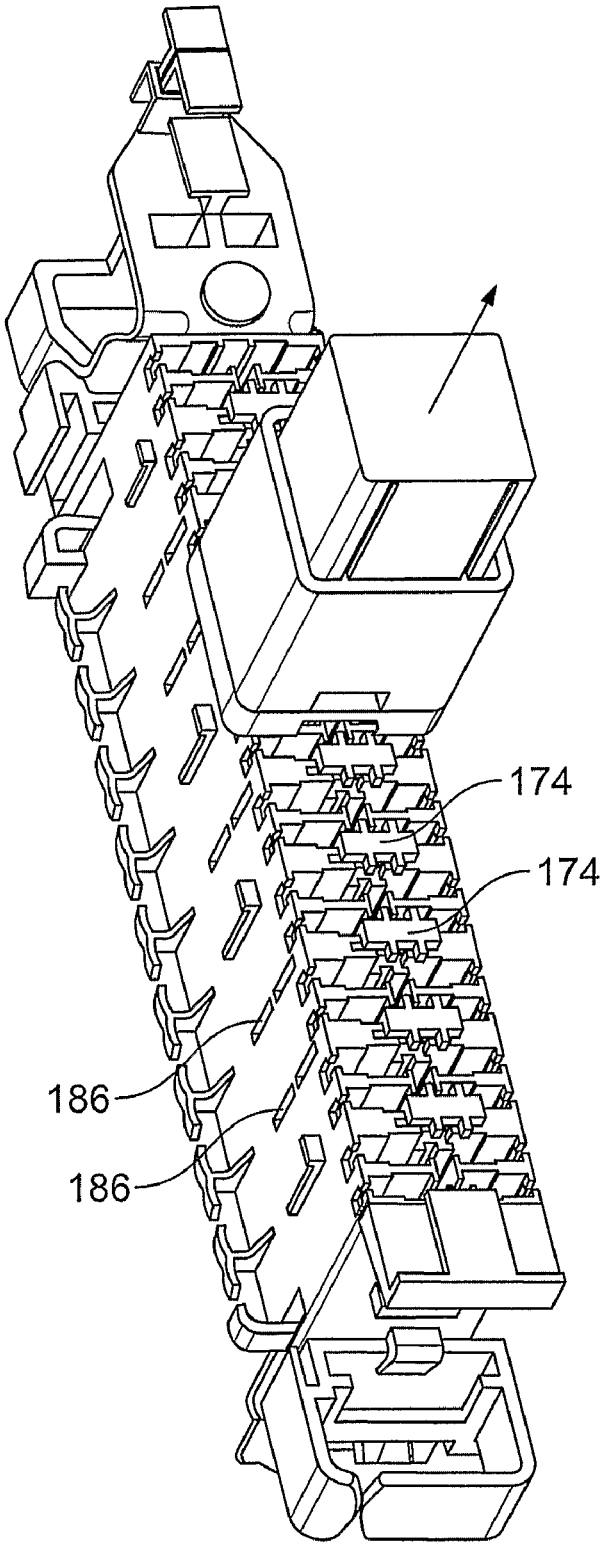
FIG. 40 is a still further view of the electrical connector of FIGS. 38 and 39 showing the assembly of the connector and the manner in which it can be used to secure wire pairs thereto.
Figure 41:
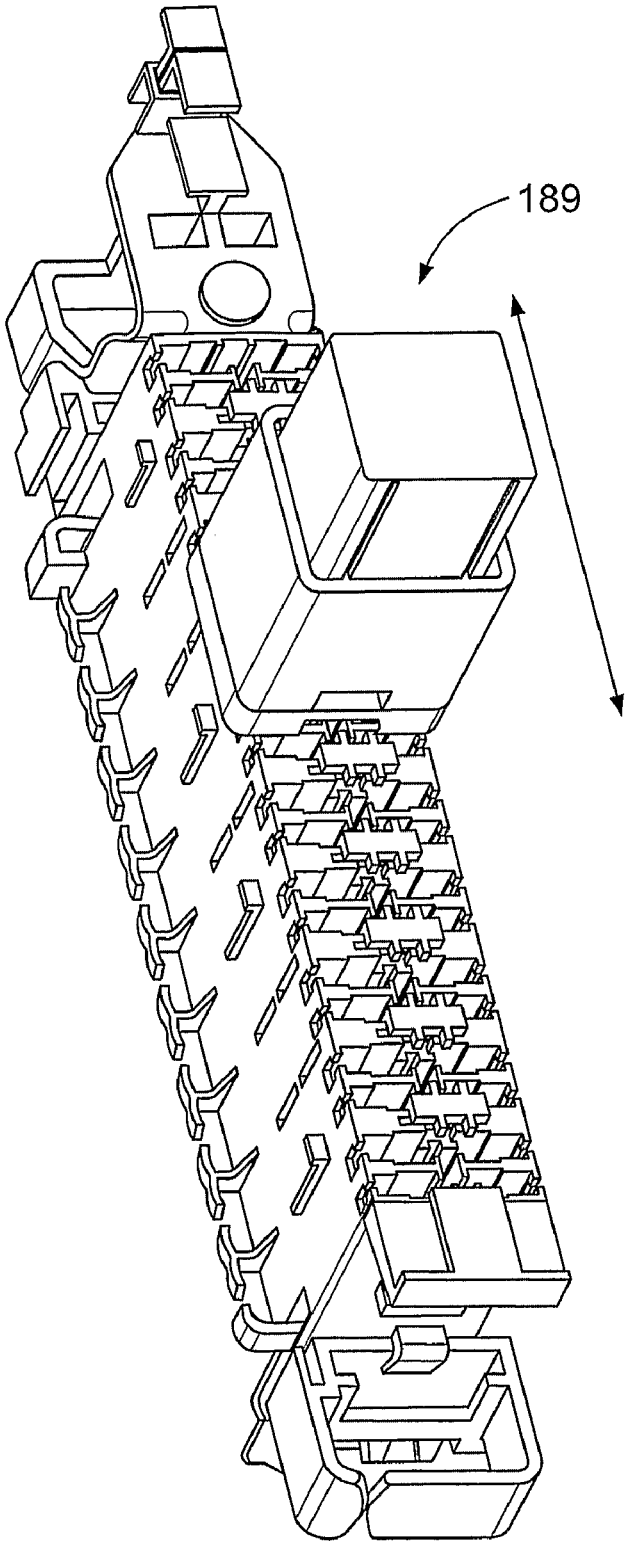
FIGS. 41 to 43 are still further views of the electrical connector of FIGS. 38 to 40 showing the assembly of the connector and the manner in which it can be used to secure wire pairs thereto.
Figure 42:
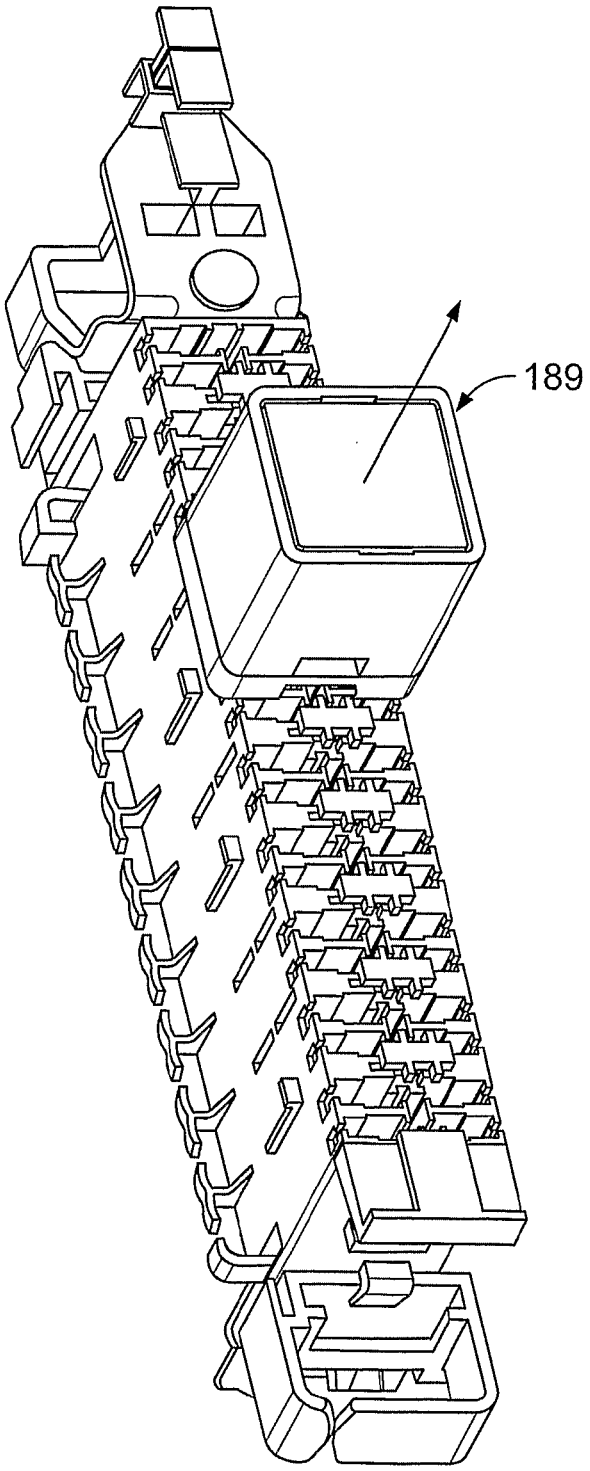
Figure 42A:
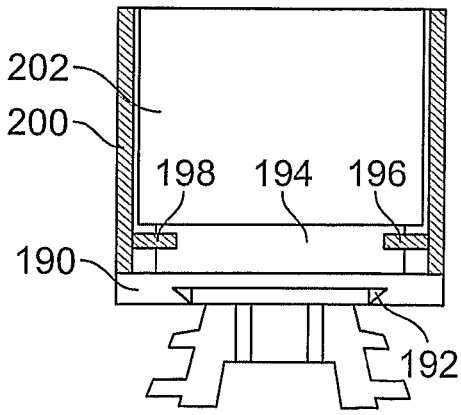
FIG. 42A is a partially sectional end view of the tool shown in FIG. 42.
Figure 43:
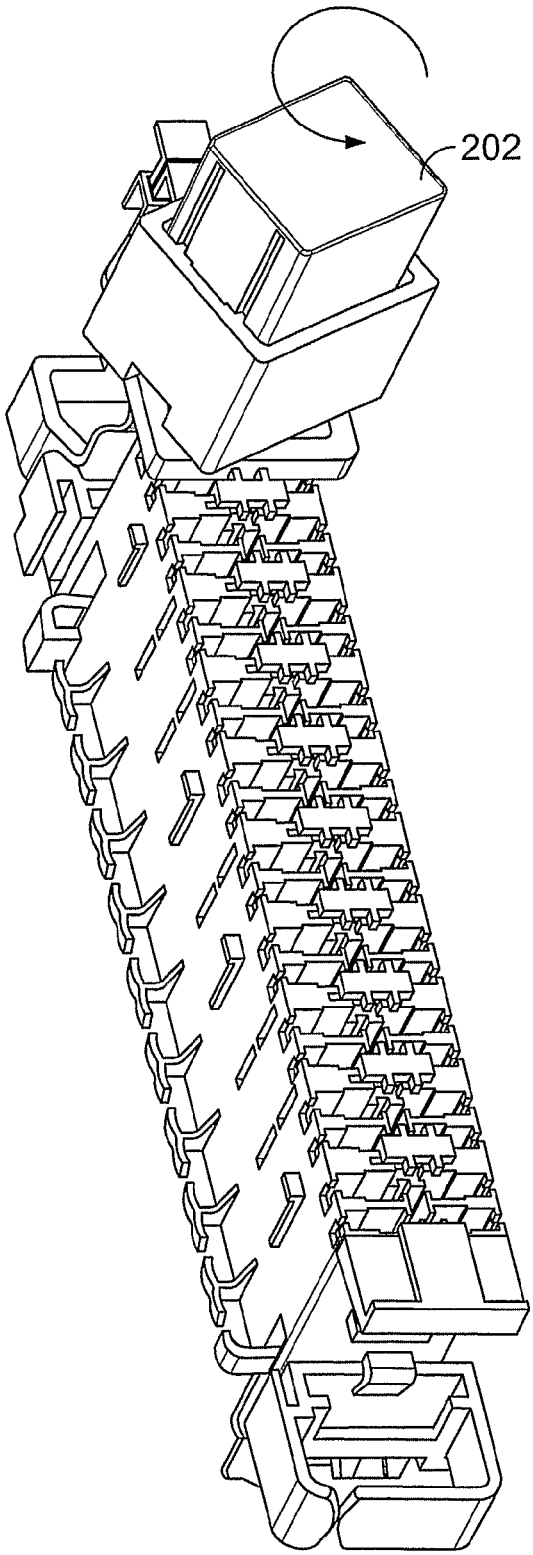
Figure 45:
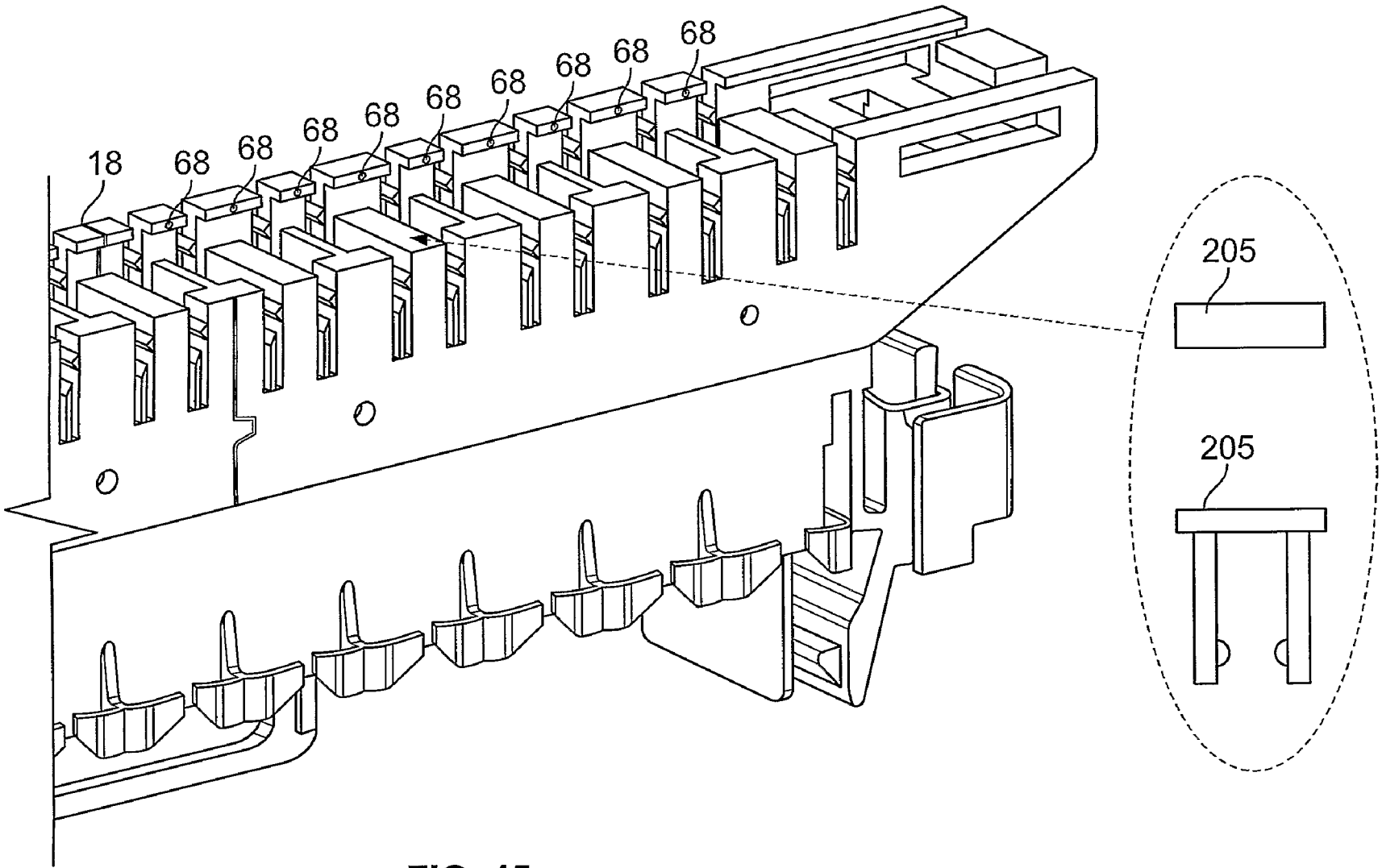

FIG. 45 shows the same connector strip as shown in FIG. 25 but showing how such a connector strip can be adapted for multiple purposes. In addition to having a slidable carrier positioned thereon to run along the slide housing 18, it is also possible by fitting replaceable segments 205, having a similar function to the segments 174 shown in FIGS. 38A and 38B, to permit a slide to move along a track provided by those segments. To this end, a segment 205 formed as shown in FIGS. 45A and 45B may be mounted centrally on transverse partitions of the connector strip, so that upper surfaces of the segments do not interfere with movement of other slide carriers along the slide housing but instead enable different types of slide carriers to be used.

Figure 46:
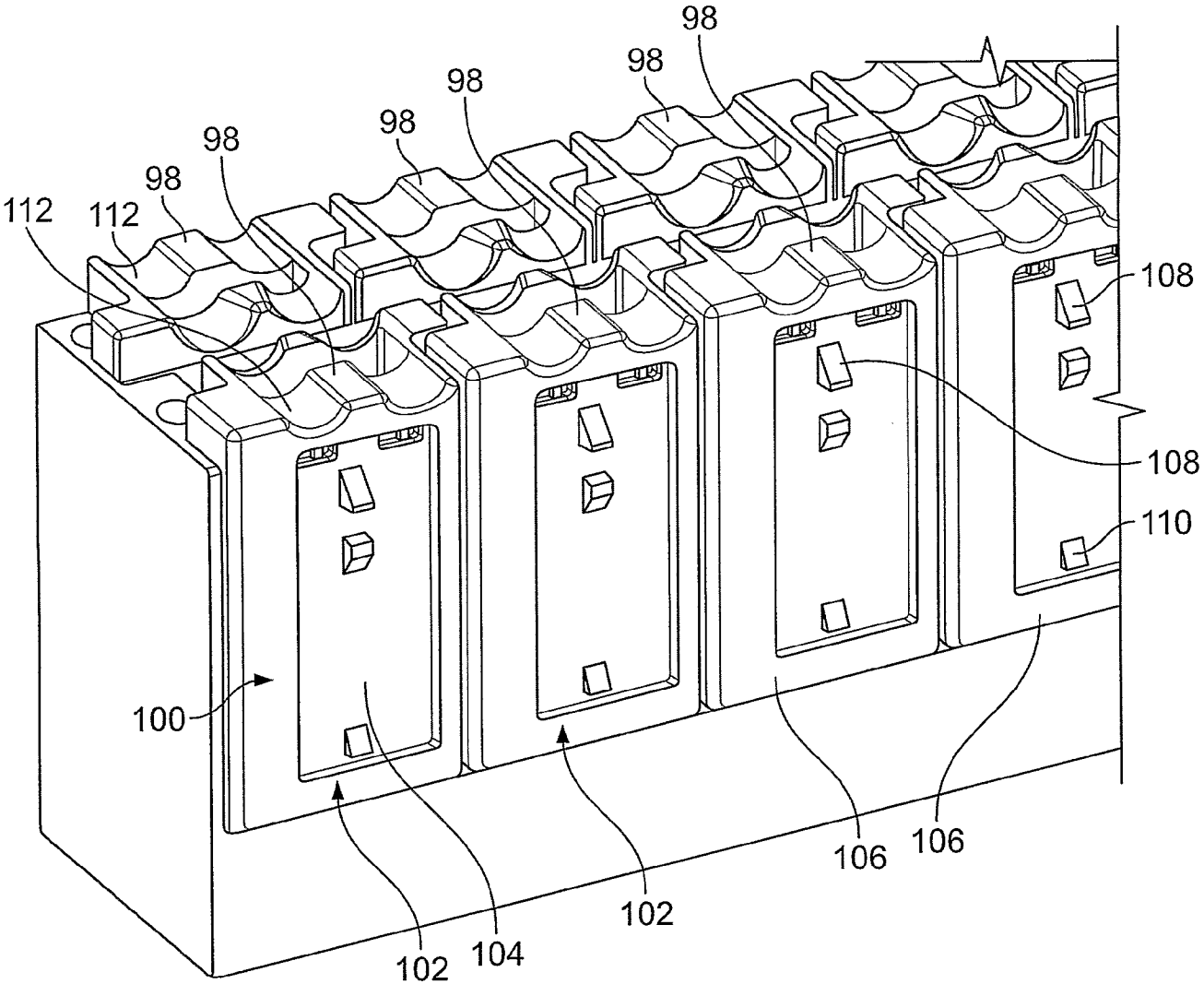
FIG. 46 is a close-up perspective view of an end portion of a further electrical connector according to the present invention in which an insertion tool is provided for each aperture of the connector.

Turning now to FIGS. 46 to 49, a further embodiment of an electrical connector according to the present invention is illustrated. As compared with the embodiments illustrated with reference to FIGS. 3 to 45, this further embodiment of the invention is concerned with the provision of a single insertion and connection tool 98 for each wire pair of incoming and outgoing wires of an individual telephone wire pair, as generally shown in FIG. 46.

The objectives in designing this further embodiment were to produce an electrical connector which permits even more efficient wire connection where the connection tools can not be mislaid, (since they would be assembled in the magazine to provide an individual tool for each incoming pair and an individual tool for each outgoing pair of the magazine) and would guide its respective pair of wires into the magazine, connect each wire in the IDC terminals, cut off the surplus end of the wires, and remain in the down position until an installing engineer may disconnect that pair.

To achieve these objectives, the insertion tool shown in FIGS. 46 to 49 comprises a one-piece moulding which comprises a slide element 100 which is substantially in the form of a rectangular frame 102 arranged to engage slidably against an external side face 104 of a connector strip 12, the slide element having a rung 106 at its lowermost extremity for engaging upper and lower lugs or detents 108, 110, respectively projecting outwardly from the face 104, as the frame moves against the face 104. The width of the frame is substantially that of the spacing allowed for provision of a two wire pair 19 in the connector strip while the depth of the frame is such as to allow the rung 106 to engage the lower lug 110 when the tool is depressed as described below to secure the slide element in its down position. The upper lug is provided to ensure that the slide element does not disengage from the connector strip.

At its uppermost extremity, the frame 102 is integral with a bridge 112 which has a lateral dimension, i.e. widthwise of the connector strip 12, which is half that of the width of the strip. The bridge provides staggered shoulder portions 114, 116 with shoulder portion 114 closer to a centre line of the strip than portion 116. Extending downwardly from shoulder portion 114 is a rod-like guide 118 while a similar guide 120 extends downwardly from shoulder portion 116 in spaced parallel relationship to guide 118. Each guide is arranged to slidably engage in elongate apertures 122 formed as wells in the connector strip 12.

Descending from the bridge is a pusher member provided by a pair of alignment and insertion members 124 and a pair of cutting blades 126 which, when the tool is engaged to strip and connect the wires, together descend into apertures 128 provided therefor, these apertures being open bottomed to permit the members and cutting blades to access wires located in position for connection by the connector strip.

The insertion tools can move up and down the apertures 128, and preferably can be constructed in a manner similar to the previous embodiments to make an audible sound such as a click indicating when each desired position of the respective tool has been reached. To make a connection of the wires to the connector strip, it is possible to thread the wire endwise into an insertion tool as shown in FIG. 46, passing the wire over the insertion tools of the other side of the connector. The wires are positioned and guided by the insertion tools. After pushing with finger or screwdriver, the insertion tool pushes the wires into the IDC terminals to connect them and cut off the excess wire. The connections of the two wires of a pair are made with one stroke of the tool, but preferably at different points within the stroke, effected by the cutting blades 126 being of different heights, thus cutting one wire at a time and requiring less force than would be necessary to cut two wires simultaneously.

Figure 47:
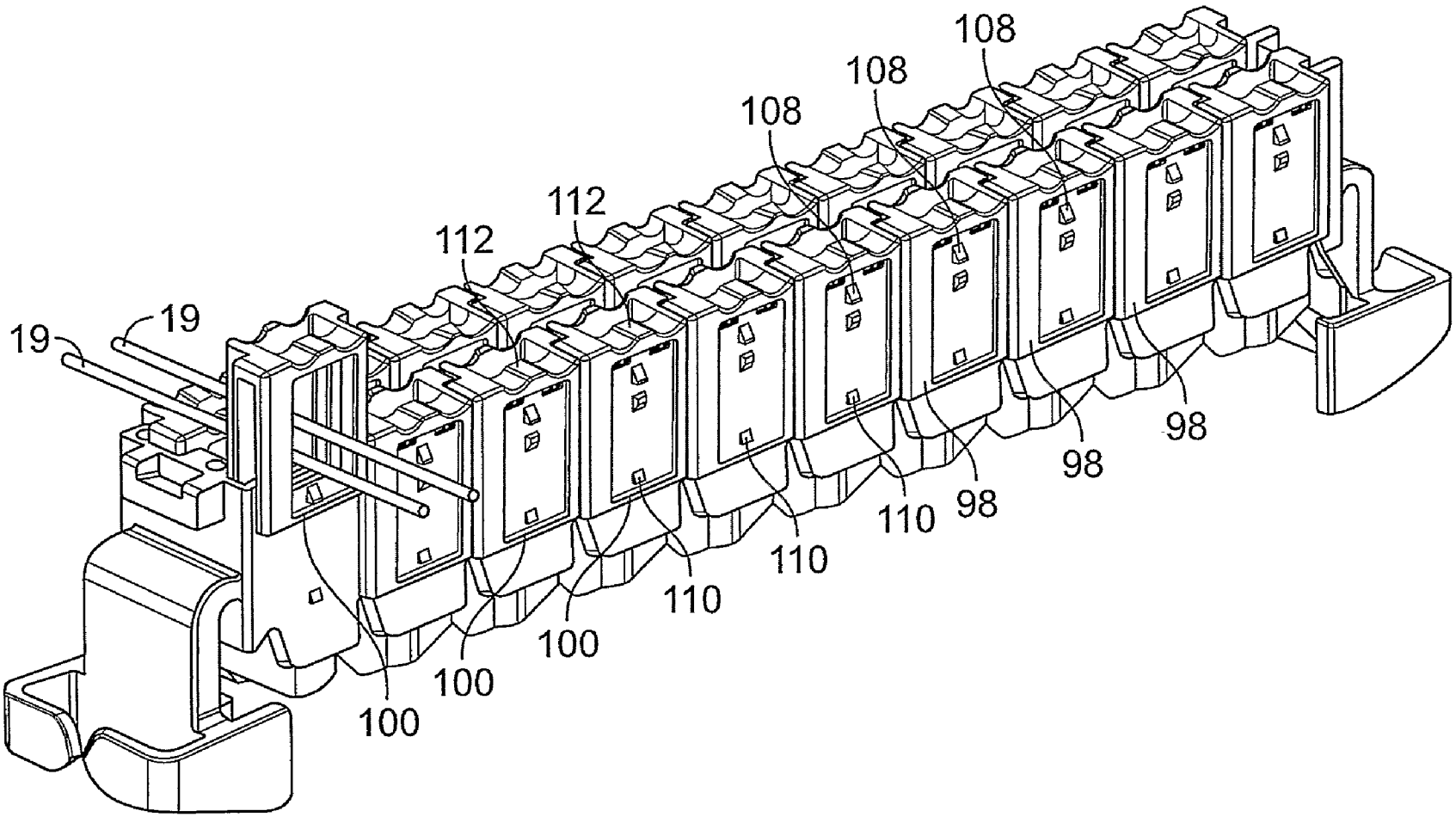
FIG. 47 is a perspective view, similar to FIG. 46 showing a complete connector and the position of an insertion tool prior to setting of wires into the connector.

When the connection is completed, the insertion tool remains in its place in the 'down' position, and, as shown in FIG. 47, the rung 106 of the frame 102 engages the lower lug 110 to retain the tool in the depressed position. It only requires a light movement to release the rung from the lug 110 to permit the tool to be raised if necessary to carry out further wiring.

Figure 48:
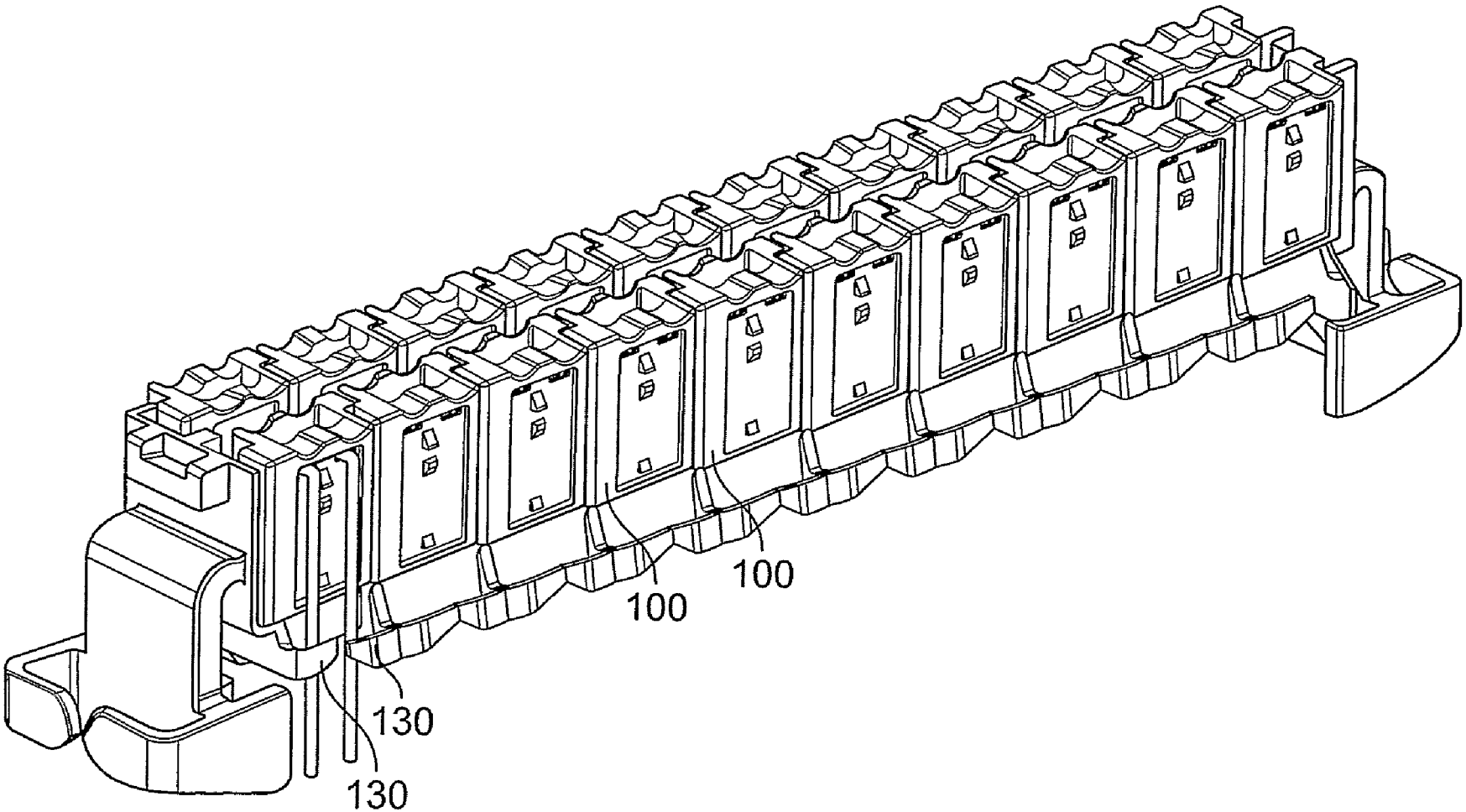
FIG. 48 is a perspective view of the connector shown in FIGS. 46 and 47 showing the wires of FIG. 46 set in the connector.
Figure 49:
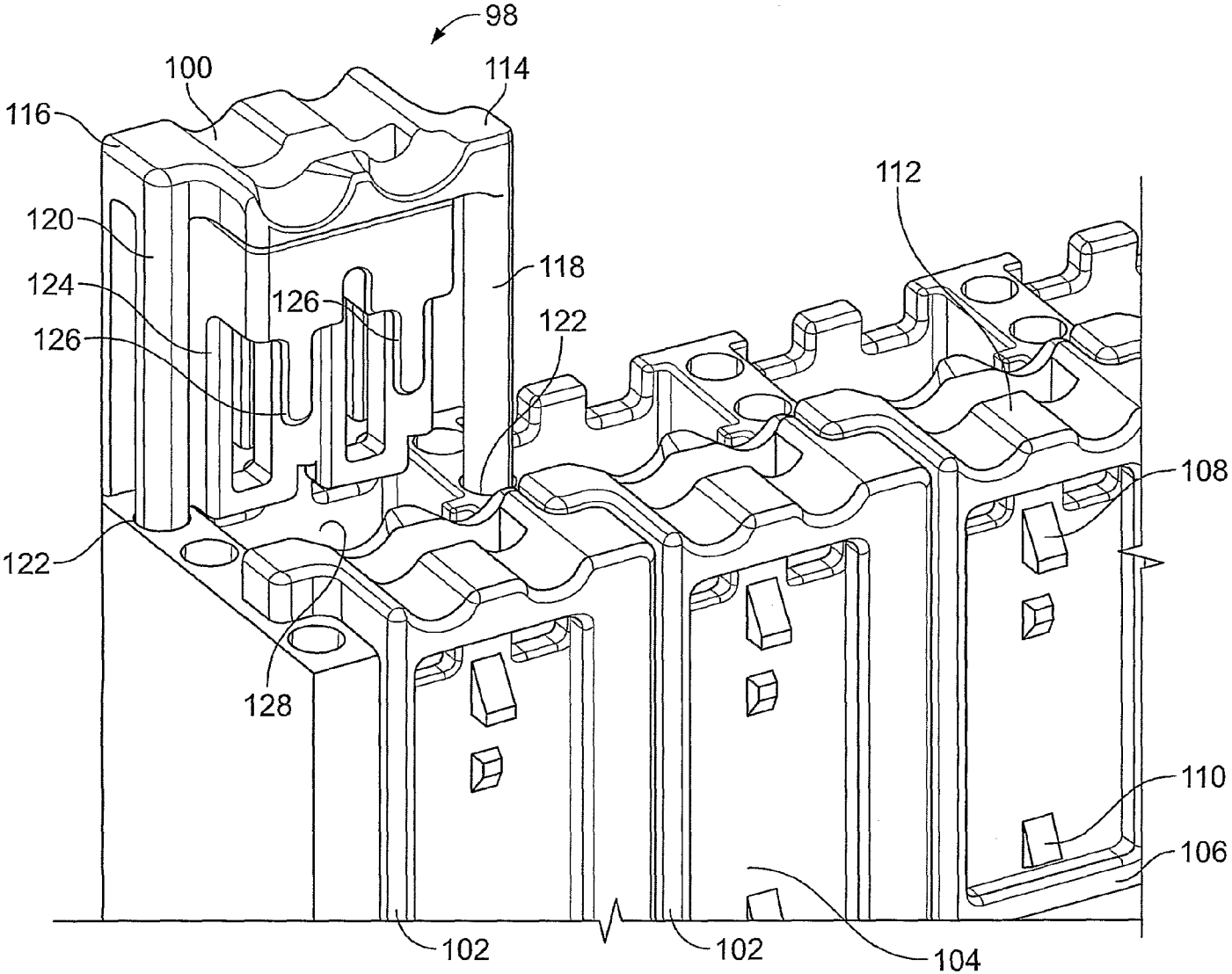
FIG. 49 is a perspective view, similar to that of FIG. 46, of an end portion of the connector in which the insertion tool is raised preparatory to insertion of wires into the connector.

Once secured, wire pairs can be entrained as shown in FIG. 48 where the wires are captured by spring clips 130.

The invention claimed is:

1. An electrical connector comprising a connector strip having at least one row of apertures containing wire connection terminals, and having at least one captive wire insertion tool capable in use of pushing or otherwise forcing wires into the terminals to establish electrical connection, wherein the tool is arranged for captive sliding movement relative to the strip to position the tool with a selected one of the apertures in which a wire connection is to be made, wherein the tool includes a spring loaded wire plunger member carried by the carrier portion in such arrangement that the plunger can be repeatedly moved to force the wires into the respective terminals.

2. An electrical connector according to claim 1, wherein the insertion tool is arranged to slide along the row of apertures of the connector strip so as to align the tool selectively with any one of the apertures in which the wire connection is to be made.

3. An electrical connector according to claim 1, wherein the tool is held captive in a slide housing which is permanently or removably mounted on top of the row of apertures in the connector strip.

4. An electrical connector according to claim 3, wherein the slide housing is a separate structure removably fitted on top of a pre-existing connector strip.

5. An electrical connector according to claim 4, wherein the slide housing is formed integrally with the connector strip.

6. An electrical connector according to claim 3, wherein the wire insertion tool comprises a slidable carrier portion, which is captively held in the slide housing.

7. An electrical connector according to claim 6, wherein the carrier portion is captively held by snap-fitting or other engagement of projections or grooves on the carrier portion with grooves or projections arranged along the sides of the slide housing extending along the connector strip adjacent to the row(s) of terminal-containing apertures.

8. An electrical connector according to claim 6, wherein the wire plunger member includes a top force applying handle for moving the plunger member relative to a tool housing.

9. An electrical connector according to claim 6, wherein the connector strip includes two or more rows of the terminal-containing apertures, having one or more tools provided on each row.

10. An electrical connector according to claim 9, wherein two or more rows of the terminal-containing apertures are provided, wherein a tool is provided having a carrier which can be rotated or otherwise moved on or in the slide housing to align the tool selectively with one row or another.

11. An electrical connector according to claim 9, having two or more rows of the terminal-containing apertures, wherein a tool is provided having a pusher which is rotatable or otherwise movable in or on the slidable carrier to align the pusher selectively with one row or another.

12. An electrical connector according to claim 11, wherein the carrier bridges both or all of the rows.

13. An electrical connector according to claim 10, wherein at least one tool carries an indicator to show the installer which of the rows of apertures the tool is aligned to act upon.

14. An electrical connector according to claim 1, wherein detent means are provided for positive location of the tool in alignment with each selected aperture.

15. An electrical connector according to claim 14, wherein the detent means is resiliently mounted on the carrier and engages with suitable depressions or other formations on the slide housing, or on the connector strip itself, to indicate that the tool has achieved correct alignment.

16. An electrical connector according to claim 15, wherein the detent means is arranged to emit an audible "click" or other sound when the aligning engagement occurs.

17. An electrical connector according to claim 4, wherein the slide housing includes an extension at one or both of its ends onto which extension the tool may be slid out of the way while wires are being laid across the apertures in the connector strip ready for insertion into the terminals.

18. An electrical connector comprising a connector strip having at least one row of apertures containing wire connection terminals, wherein some or all of the apertures have individually dedicated manually-engageable wire insertion and cutting tools pre-inserted therein or immovably aligned therewith, each such tool being dedicated to establish electrical connection by pushing or otherwise forcing a wire into the terminals exclusively of its own aligned aperture or apertures, wherein each such tool has a cross-sectional area substantially equal to that of its aligned aperture and an associated cut-off blade or other member for cutting off the free end of the wire extending beyond the terminals.

19. An electrical connector according to claim 18, wherein the individually dedicated wire insertion tools are at least partially inserted in the apertures.

20. An electrical connector according to claim 18, wherein each wire insertion tool is formed as a one piece element having guides arranged to be received in the connector strip whereby the wire insertion tool can move linearly between a position awaiting insertion of wires into the connector and a position in which the tool retains the wires therein.

21. An electrical connector according to claim 20, wherein the wire insertion tool is formed with a part arranged to engage detents provided on or by the connector strip to retain the tool in each of the two positions.

22. A component for use with an electrical connector comprising a connector strip having at least one row of apertures containing wire connection terminals, and having at least one wire insertion tool capable in use of pushing or otherwise forcing wires into the terminals to establish electrical connection, the tool including a wire plunger member including a force applying handle for moving the plunger member relative to a tool housing carried by the carrier portion in such arrangement that the plunger can be repeatedly moved to force the wires into the respective terminals, the component comprising a slide housing in a form suitable for fitting onto the pre-existing connector strip, with or without the said wire insertion tool pre-fitted in the slide housing.

23. A component according to claim 22, wherein the slide housing comprises walls which at least partially engage with the connector strip to secure the slide housing thereon.

24. A component according to claim 23, wherein the walls of the slide housing are separated by integrally formed spaced apart partitions which can permit access to terminals of the connector strip.

25. A connector strip having at least two rows of apertures containing wire connection terminals, and having at least one captive wire insertion tool capable in use of pushing or otherwise forcing wires into the terminals to establish electrical connection, the tool comprising a wire insertion member laterally aligned with one row, wherein the tool is arranged for captive sliding movement along the rows to align the wire insertion member selectively with any one of the apertures in which a wire connection is to be made, and being rotatable to align the wire insertion member with any one of the apertures of the other said row.

26. An electrical connector comprising a connector strip having at least one row of apertures containing wire connection terminals, and having at least one captive wire insertion tool capable in use of pushing or otherwise forcing wires into the terminals to establish electrical connection, wherein the tool is arranged for captive sliding movement relative to the strip to position the tool with a selected one of the apertures in which a wire connection is to be made; the tool is held captive in a slide housing which is permanently or removably mounted on top of the row of apertures in the connector strip; the wire insertion tool comprises a slidable carrier portion, which is captively held in the slide housing; the connector strip includes two or more rows of the terminal-containing apertures, having one or more tools provided on each row; and wherein two or more rows of the terminal-containing apertures are provided, wherein the tool is provided having a carrier which can be rotated or otherwise moved on or in the slide housing to align the tool selectively with one row or another.

27. An electrical connector according to claim 26, wherein at least one tool carries an indicator to show the installer which of the rows of apertures the tool is aligned to act upon.

28. An electrical connector comprising a connector strip having at least one row of apertures containing wire connection terminals, and having at least one captive wire insertion tool capable in use of pushing or otherwise forcing wires into the terminals to establish electrical connection, wherein the tool is arranged for captive sliding movement relative to the strip to position the tool with a selected one of the apertures in which a wire connection is to be made; the tool is held captive in a slide housing which is permanently or removably mounted on top of the row of apertures in the connector strip; the wire insertion tool comprises a slidable carrier portion, which is captively held in the slide housing; the connector strip includes two or more rows of the terminal-containing apertures, having one or more tools provided on each row; and having two or more rows of the terminal-containing apertures, wherein a tool is provided having a pusher which is rotatable or otherwise movable in or on the slidable carrier to align the pusher selectively with one row or another.

29. An electrical connector according to claim 28, wherein the carrier bridges both or all of the rows.

* * * * *